US009171704B2

(12) United States Patent
Morokuma et al.

(10) Patent No.: US 9,171,704 B2
(45) Date of Patent: Oct. 27, 2015

(54) MASS SPECTROMETER

(71) Applicant: HITACHI HIGH-TECHNOLOGIES CORPORATION, Tokyo (JP)

(72) Inventors: Hidetoshi Morokuma, Hitachinaka (JP); Yuichiro Hashimoto, Tachikawa (JP); Masuyuki Sugiyama, Hino (JP); Masuyoshi Yamada, Ichikawa (JP); Hideki Hasegawa, Tachikawa (JP)

(73) Assignee: HITACHI HIGH-TECHNOLOGIES CORPORATION, Tokyo (JP)

( * ) Notice: Subject to any disclaimer, the term of this patent is extended or adjusted under 35 U.S.C. 154(b) by 0 days.

(21) Appl. No.: 14/491,298

(22) Filed: Sep. 19, 2014

(65) Prior Publication Data

US 2015/0041641 A1 Feb. 12, 2015

Related U.S. Application Data

(63) Continuation of application No. 13/289,633, filed on Nov. 4, 2011, now Pat. No. 8,866,070.

(30) Foreign Application Priority Data

Nov. 8, 2010 (JP) ..... 2010-249260

(51) Int. Cl.
*H01J 49/00* (2006.01)
*H01J 49/04* (2006.01)
(Continued)

(52) U.S. Cl.
CPC ..... *H01J 49/0013* (2013.01); *H01J 49/0031* (2013.01); *H01J 49/0422* (2013.01);
(Continued)

(58) Field of Classification Search
CPC ..... H01J 49/24; H01J 49/04; H01J 49/0495
USPC ..... 250/281, 282, 288
See application file for complete search history.

(56) References Cited

U.S. PATENT DOCUMENTS 4,137,750 A * 2/1979 French et al. ..... 73/23.2
4,209,696 A 6/1980 Fite
(Continued)

FOREIGN PATENT DOCUMENTS

JP 59-004828 B2 2/1984
JP 59-162447 A 9/1984
(Continued)

OTHER PUBLICATIONS

Japanese Office Action issued in Japanese Patent Application No. JP 2010-249260 dated Oct. 29, 2013.
(Continued)

*Primary Examiner* — Michael Maskell
(74) *Attorney, Agent, or Firm* — McDermott Will & Emery LLP

(57) ABSTRACT

A mass spectrometer of reduced size and weight is provided which is capable to conduct highly accurate mass spectroscopy. The mass spectrometer includes an ion source adapted to ionize gas flowing in from outside in order to ionize a measurement sample and a mass spectroscopy section for separating the ionized measurement sample. The ion source has its interior reduced in pressure by differential pumping from the mass spectroscopy section and ionizes the gas when the interior pressure rises as it inhales the gas, and the mass spectroscopy section separates the ionized measurement sample when its interior pressure falls after inhale of the gas. The mass spectrometer may further include a restriction device for suppressing a flow rate of the gas the ion source inhales and an open/close device for opening and closing a flow of the gas the ion source inhales.

8 Claims, 13 Drawing Sheets

(51) Int. Cl.
*H01J 49/24* (2006.01)
*H01J 49/10* (2006.01)
*H01J 49/26* (2006.01)

(52) U.S. Cl.
CPC ..... *H01J49/0495* (2013.01); *H01J 49/10* (2013.01); *H01J 49/105* (2013.01); *H01J 49/24* (2013.01); *H01J 49/26* (2013.01)

(56) References Cited

U.S. PATENT DOCUMENTS

| | | | | |
|---|---|---|---|---|
| 4,849,628 | A * | 7/1989 | McLuckey et al. | 250/282 |
| 7,064,320 | B2 * | 6/2006 | Yamada et al. | 250/288 |
| 7,592,589 | B2 | 9/2009 | Hashimoto et al. | |
| 2004/0089799 | A1 | 5/2004 | Kawato et al. | |
| 2010/0301209 | A1 * | 12/2010 | Ouyang et al. | 250/288 |
| 2011/0042560 | A1 | 2/2011 | Ouyang et al. | |
| 2011/0108726 | A1 * | 5/2011 | Hiraoka et al. | 250/282 |
| 2011/0253889 | A1 * | 10/2011 | Ishimaru et al. | 250/282 |
| 2013/0105683 | A1 * | 5/2013 | Ouyang et al. | 250/282 |

FOREIGN PATENT DOCUMENTS

| | | | |
|---|---|---|---|
| JP | 2004-158267 | A | 6/2004 |
| WO | 2009/023361 | A2 | 2/2009 |
| WO | 2009031179 | A1 | 3/2009 |
| WO | 2009/102766 | A1 | 8/2009 |
| WO | 2009/127312 | A1 | 10/2009 |

OTHER PUBLICATIONS

Chinese Office Action issed in Chinese Application No. 201110353331.X dated Jan. 8, 2014.

* cited by examiner

<VARIATION 5 OF SECOND EMBODIMENT>

<VARIATION 6 OF SECOND EMBODIMENT>

MASS SPECTROMETER

CROSS REFERENCE TO RELATED APPLICATIONS

This application is a continuation of U.S. patent application Ser. No. 13/289,633, filed on Nov. 4, 2011, which claims priority to Japanese Patent Application No. 2010-249260, filed on Nov. 8, 2010, the disclosures of each are hereby incorporated by reference herein.

BACKGROUND OF THE INVENTION

The present invention relates to mass spectrometers and, more particularly, to a mass spectrometer suitable for reduction of its size and weight.

In a mass spectrometer, an ionized measurement sample is analyzed for its mass in a mass spectroscopy section. While the mass spectroscopy section is housed in a vacuum chamber and maintained at a high vacuum of 0.1 Pa or lower, ionization of a measurement sample is performed in the atmospheric pressure as shown in U.S. Pat. No. 7,064,320 or in a reduced pressure of about 10 to 100 Pa as shown in U.S. Pat. No. 4,849,628, so that there is a difference between a pressure in an environment for execution of ionization and a pressure in an environment for execution of mass spectroscopy. Accordingly, in order to introduce an ionized measurement sample to the mass spectroscopy section while keeping the degree of vacuum (pressure) in the mass spectroscopy section within a range capable of mass spectroscopy, a differential pumping scheme has been proposed as shown in U.S. Pat. No. 7,592,589. Further, WO 2009/023361 proposes, in addition to the differential pumping scheme, a scheme in which an ionized measurement sample is introduced intermittently to the mass spectroscopy section. Furthermore, in order to improve measurement sensitivity of mass spectroscopy, ionization schemes utilizing dielectric barrier discharge phenomena have been proposed as ionization schemes capable of highly efficient ionization in WO 2009/102766 and WO 2009/157312.

SUMMARY OF THE INVENTION

According to the scheme of intermittently introducing an ionized measurement sample to the mass spectroscopy section of WO 2009/023361, the degree of vacuum in the mass spectroscopy section which degrades by the introduction can recover while the introduction is halted to permit mass spectroscopy to be carried out in high vacuum environment. This scheme can maintain the mass spectroscopy section at high vacuum even with a small-sized vacuum pump and is hence advantageous in reducing size and weight of the mass spectrometer.

Conceivably, the scheme of intermittently introducing the ionized measurement samples to the mass spectroscopy section, however, has a greater loss of the ionized measurement samples during their transport than in the case of continuous introduction with the differential pumping scheme only. In order to secure an amount of the ionized measurement samples necessary for highly accurate measurement in the mass spectroscopy section, as well as reducing the loss during transport as described above, assuring the highly efficient ionization is desired so as to enable highly accurate measurement even with a mass spectrometer of reduced size and weight.

Accordingly, a problem to be solved by the present invention is to provide a mass spectrometer of reduced size and weight which is capable to conduct highly accurate mass spectroscopy.

To accomplish the above objective, a mass spectrometer according to an embodiment of the present invention comprises an ion source adapted to ionize gas flowing in from outside in order to ionize a measurement sample and a mass spectroscopy section for separating the ionized measurement sample, wherein the ion source has its interior reduced in pressure by differential pumping from the mass spectroscopy section and ionizes the gas when its interior pressure rises up to about 100 Pa to about 10,000 Pa as it inhales the gas, and the mass spectroscopy section separates the ionized measurement sample when its interior pressure raised concomitantly with inhale of the gas falls to about 0.1 Pa or lower after inhale of the gas.

According to the present invention, a mass spectrometer of reduced size and weight which is capable to conduct highly accurate mass spectroscopy can be provided.

Other objects, features, and advantages of the invention will become apparent from the following description of the embodiments of the invention taken in conjunction with the accompanying drawings.

DETAILED DESCRIPTION OF THE EMBODIMENTS

The embodiments of the present invention will now be described in greater details by making reference to the accompanying drawings as needed. Incidentally, common parts in the respective drawings are designated by identical reference signs and redundant explanations are omitted.

First Embodiment

Figure 1A:
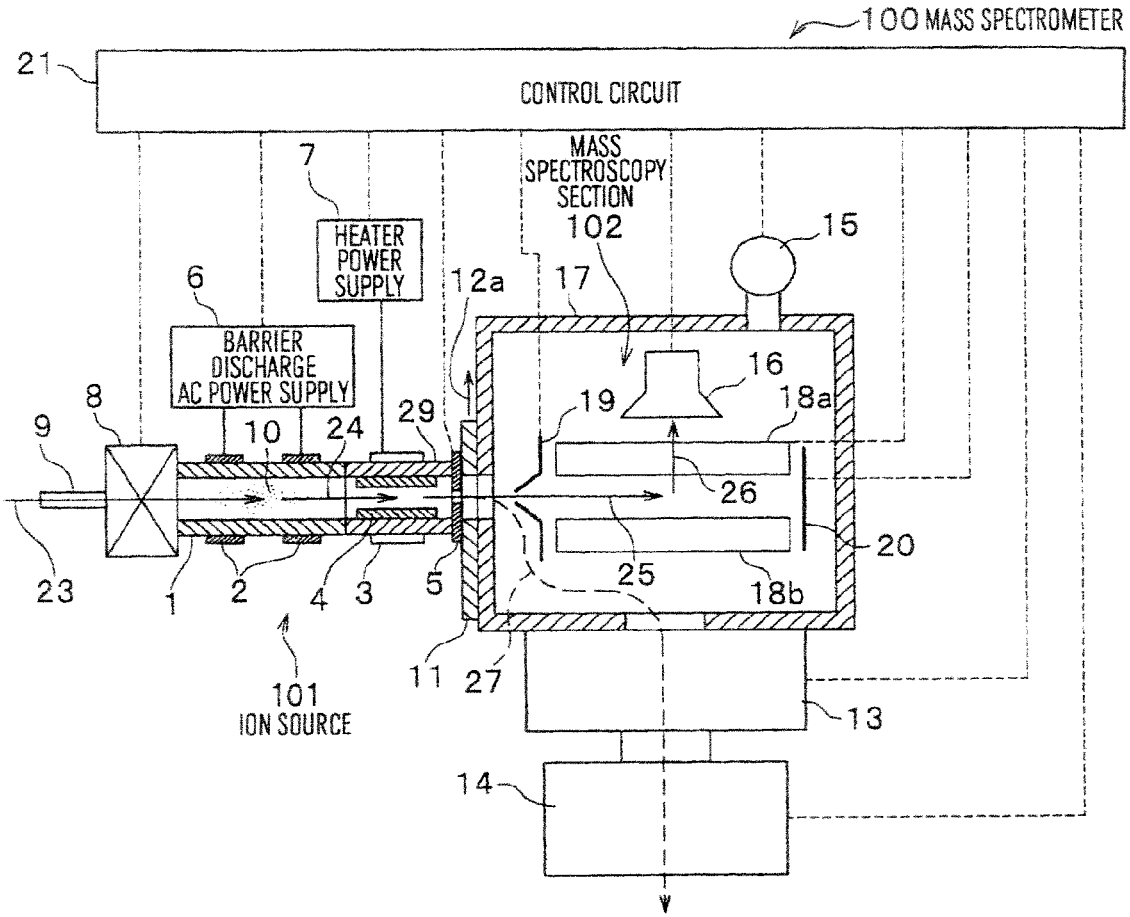
FIG. 1A is a configuration diagram of a mass spectrometer according to a first embodiment of the present invention.

Shown in FIG. 1A is a configuration diagram of a mass spectrometer 100 according to a first embodiment of the present invention. The mass spectrometer 100 is equipped with a vacuum chamber 17. To the vacuum chamber 17 a turbomolecular pump 13 and a roughing pump 14 are connected in series. With this configuration the interior of the vacuum chamber 17 can be evacuated down to a high vacuum of about 0.1 Pa or lower. The vacuum chamber 17 is provided with a vacuum gauge 15 which measures the degree of vacuum (pressure) inside the vacuum chamber 17. The measured degree of vacuum is transmitted to a control circuit 21. Based on the received degree of vacuum, the control circuit 21 controls operation of the turbomolecular pump 13 and the roughing pump 14.

Inside the vacuum chamber 17 a mass spectroscopy section 102 is stored. Although details are described later, ion accumulation, ion selection, ion dissociation, mass scan, and the like are carried out in the mass spectroscopy section 102 to separate target ions from ionized samples (measurement samples) 4.

The vacuum chamber 17 has an inlet for introducing the ionized samples 4 and a chamber open/close device 11 for opening/closing the inlet. As the chamber open/close device 11, a slide valve having a through-hole of a diameter of about 5 mm to 10 mm approximating that of the inlet may be used.

An orifice (first orifice) 5 is provided overlapping the chamber open/close device (slide valve) 11 and the inlet of the vacuum chamber 17. The orifice 5 may have an aperture diameter of about 0.1 mm to 1 mm. Incidentally, a capillary (first capillary) may be used in place of the orifice 5.

The orifice 5 is connected with a sample container 29. The sample container 29 is open at both ends and a container like a pipe (tube) may be used therefor. Then, one open end is connected to the orifice 5 and the other open end is connected to a dielectric container (dielectric bulkhead) 1 of an ion source 101. A sample (measurement sample) 4 is disposed inside the sample container 29. When the sample 4 is liquid, it is adsorbed by a glass filter paper, a solid phase extraction sorbent, or the like and is arranged inside the sample container 29 with passages of air secured. When the sample is solid, it can be disposed inside the sample container 29 as is or the sample 4 can be rubbed on a glass filter paper and can then be disposed inside the sample container 29. When the sample 4 is hard to vaporize, by warming with a heater 3 arranged outside of the sample container 29 vaporization of the sample 4 may be enhanced. Electric power is provided by a heater power supply 7 for the heater 3 and the control circuit 21 can adjust the electric power to control on/off of the heater 3 and temperature.

The ion source 101 has the dielectric container (dielectric bulkhead) 1 and barrier discharge electrodes (first electrode and second electrode) 2. The dielectric container (dielectric bulkhead) 1 is open at both ends and has a form of a pipe (tube). One open end is connected to a pulse valve (open/close device) 8. The other open end is connected to the sample container 29 to put the dielectric container (dielectric bulkhead) 1 in communication with the sample container 29.

The paired barrier discharge electrodes (first and second electrodes) 2 are arranged in the way that an alternating-current (AC) voltage can be applied through the dielectric container (dielectric bulkhead) 1. Magnetic and electric field lines generated between the paired barrier discharge electrodes (first and second electrodes) 2 pass through the dielectric container (dielectric bulkhead) 1. The paired barrier discharge electrodes (first and second electrodes) 2 are arranged outside of the dielectric container (dielectric bulkhead) 1 along the dielectric container (dielectric bulkhead) 1. The AC voltage is applied to the barrier discharge electrodes (first and second electrodes) 2 by a barrier discharge AC power supply 6. Control of on/off of this AC voltage and the like is performed by the control circuit 21. Then, with the AC voltage applied, electric discharge occurs inside the dielectric container (dielectric bulkhead) 1 and gas inhaled in the ion source 101 and flowing through the interior of the dielectric container (dielectric bulkhead) 1 is ionized.

One end of the pulse valve (open/close device) 8 is connected to the ion source 101 and the other end of the pulse valve (open/close device) 8 is connected to a capillary (restriction device, second capillary) 9. Incidentally, an orifice (second orifice) may be used in place of the capillary (restriction device, second capillary) 9. The capillary (restriction device, second capillary) 9 can suppress the flow rate of gas (air) inhaled by the ion source 101. The pulse valve (open/close device) 8 can open/close a flow of the gas the ion source 101 inhales.

Open and close of the pulse valve (open/close device) 8 can be controlled by the control circuit 21. As for the pulse valve 8, a needle valve, a pinch valve, a globe valve, a gate valve, a ball valve, a butterfly valve, a slide valve, or the like can be used. The pulse valve 8 can open and close in a short time such as an open period of about 200 msec or less. In other words, the pulse valve 8 can operate to open from its closure and, thereafter, to again close within a short period of time of about 200 msec or less.

Between the outside atmosphere (air) and the dielectric container 1 of the ion source 101 the capillary 9 and the pulse valve 8 are connected in series. An assembly of the dielectric container 1 and the sample container 29 is connected to the vacuum chamber 17 through the orifice 5 and the like. Accordingly, with the pulse valve 8 closed and the slide valve 11 open, the interior of the dielectric container 1 and that of the sample container 29 are differentially pumped via the orifice 5 to be decompressed.

When, under this condition, the pulse valve 8 is opened, the external (outside) atmosphere (air) flows into the ion source 101 via the capillary 9 and the pulse valve 8, causing a flow of atmosphere (air) 23. The external atmosphere (air) is inhaled into the dielectric container 1 of the ion source 101. In the ion source 101, part of the air is ionized and reactant ions are generated. The reactant ions flow as a flow of reactant ions 24 from the ion source 101 into the sample container 29. In the sample container 29, the reactant ions cause ion molecular reactions with the vaporized sample 4, with the result that the vaporized sample 4 changes to sample molecular ions (ionized sample 4). Through the orifice 5 a flow of sample molecular ions 25 is generated which flows into the vacuum chamber 17 (the mass spectroscopy section 102). On the other hand, the air which is not ionized and the sample 4 which is vaporized but not ionized flow through the orifice 5 and the vacuum chamber 17 into the turbomolecular pump 13 and the roughing pump 14, to generate a flow of gas molecules 27 to be exhausted. It should be noted, incidentally, that the atmosphere (air) flowing into the ion source 101 may be either air per se or a gas containing air: for example, the air may be mixed with a gas which makes barrier discharge occur more easily.

As described above, in the mass spectrometer 100, the flows of air and ions (gas) 23, 24, 25, and 27 are generated in specific directions on specific flow channels and based on the flows 23, 24, 25, and 27, an upstream and a downstream can be established. More specifically, the pulse valve (open/close device) 8 and the capillary (restriction device, second capillary) 9 are arranged on the upstream side of the flows of air and ions (gas) 23, 24, 25, and 27 with respect to the ion source 101. The sample 4 (sample container 29) is arranged on the downstream side of the flows of air and ions (gas) 23, 24, 25, and 27 with respect to the ion source 101. The sample 4 (sample container 29) and the ion source 101 are arranged on the upstream side of the flows of air and ions (gas) 23, 24, 25, and 27 with respect to the orifice 5 and the vacuum chamber 17.

Then, when operating the mass spectrometer 100, the pulse valve 8 is first closed for a sufficient period of time so that the interior of the vacuum chamber 17 reaches a degree of vacuum of 0.1 Pa or lower and the interiors of the dielectric container 1 and the sample container 29 reach a degree of vacuum of several tens to several hundreds of Pa. Under this condition, the pulse valve 8 is opened for a prescribed short duration of time and closed. A small amount of atmosphere (air) flows into the interior of the dielectric container 1 and that of the sample container 29 via the capillary 9 (flow of the atmosphere 23). Since the flow rate (per a unit time) of atmosphere flowing in is limited with good reproducibility by the capillary 9, pressures in the interior of the dielectric container 1 and that of the sample container 29 can be raised slowly with good reproducibility. Further, since the pulse valve 8 is opened for a prescribed short duration of time and closed, the maximum value of the pressure raised by the inflow to the interior of the dielectric container 1 and that of the sample container 29 can be suppressed to less than the atmospheric pressure with good reproducibility. After closure of the pulse valve 8, the pressures inside the dielectric container 1 and the sample container 29 which are once increased can be decreased slowly with good reproducibility in differential pumping by the use of the orifice 5. Therefore, the time for the pressure inside the dielectric container 1 to belong to a pressure band of 100 Pa to 10,000 Pa in the course of increase and decrease of the interior pressure can be secured to be long with good reproducibility. In this pressure band of 100 Pa to 10,000 Pa, dielectric barrier discharge is executed with the atmosphere (air) as a principal discharge gas and reactant ions can be generated highly efficiently from molecules in the air. Then, by adjusting the discharge time or the like of the dielectric barrier discharge, the reactant ions to create a necessary amount of target ions for high performance mass spectroscopy can be generated. The reactant ions undergo ion molecular reactions with the sample 4 vaporized in the sample container 29, thereby ionizing the vaporized sample 4 to generate a necessary amount of sample molecular ions (target ions) for high-performance mass spectroscopy. Also, since the ion source 101 is coupled straight to the mass spectroscopy section 102 (vacuum chamber 17) via the sample container 29 and the orifice 5, the distance from the ion source 101 to the mass spectroscopy section 102 can be minimized and the transport loss of the reactant ions and the sample molecular ions can be minimized. In this manner, high-performance mass spectroscopy can be achieved.

Incidentally, coupled with short opening of the pulse valve 8, the pressure inside the vacuum chamber 17 also increases once and decreases. Even the pulse valve 8 is opened and closed, an increase in the pressure inside the vacuum chamber 17 can be suppressed to be small by the capillary 9, the pulse valve 8, and the orifice 5, so that, after the closure of the pulse valve 8, the pressure can fall within a short period of time to 0.1 Pa or lower which is sufficient to enable the mass spectroscopy section 102 to conduct mass spectroscopy. Since the pressure can be decreased within a short period of time, the capacity of both the turbomolecular pump 13 and the roughing pump 14 can be small and reduction of the size and the weight of the mass spectrometer 100 can be achieved. In addition, because the pressure can be decreased within a short period of time, execution of repetitive measurement of the mass spectroscopy can be facilitated.

In order to transport the sample molecular ions having flown into the vacuum chamber 17 to a central region of the mass spectroscopy section 102, suitable bias voltage are applied to the orifice 5 and an in-cap electrode 19 so that the sample molecular ions are accelerated toward the central region of the mass spectroscopy section 102. For example, when the sample molecular ions desired to be measured are negative, a potential applied to the orifice 5 can be set to about +20 V and a potential applied to the in-cap electrode 19 can be set to about +50 V. By applying such bias voltages, positive ions not to be measured can be prevented from entering the mass spectroscopy section 102.

The sample molecular ions passing through the in-cap electrode 19 and entering the central region of the mass spectroscopy section 102 are trapped (ion-accumulated) by an electric field formed by linear ion trap electrodes 18*a*, 18*b*, and the like, the in-cap electrode 19, and an end cap electrode 20.

Figure 1B:
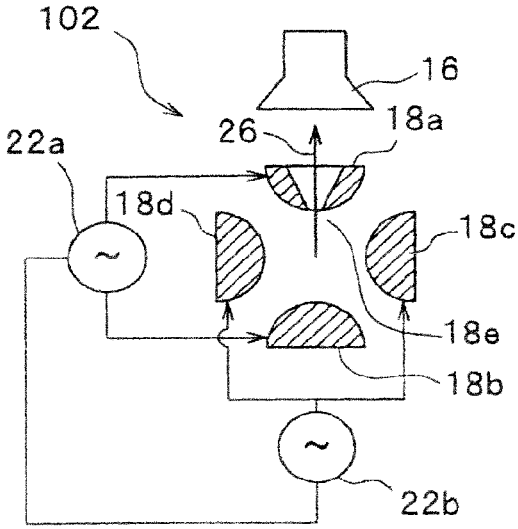
FIG. 1B is a configuration diagram of a mass spectroscopy section of the mass spectrometer according to the first embodiment of the present invention.

FIG. 1B shows a configuration diagram of the mass spectroscopy section 102. An explanation will be given to the mass spectroscopy section 102 by way of example of a linear ion trap mass spectroscopy as illustrated in FIG. 1B. The mass spectroscopy section 102 includes a linear ion trap and the linear ion trap has four quadrupole rod electrodes (linear ion trap electrodes) 18*a*, 18*b*, 18*c*, and 18*d*. Between adjacent electrodes among the linear ion trap electrodes 18*a*, 18*b*, 18*c*, and 18*d*, a trap RF voltage is applied by a linear ion trap electrode power supply 22*b*. The trap RF voltage is known to have different optimum values depending upon the sizes of the electrodes and the range of measured mass and typically, an RF (power supply) having an amplitude of 5 kV or less and a frequency of about 500 kHz to 5 MHz is used. By applying the trap RF voltage, ions such as sample molecular ions or the like can be trapped (ion-accumulated) in a space surrounded by the four linear ion trap electrodes 18*a*, 18*b*, 18*c*, and 18*d*.

Further, across a pair of opposing linear ion trap electrodes 18*a* and 18*b*, an auxiliary AC voltage is applied by another linear ion trap electrode power supply 22*a*. Typically, for the auxiliary AC voltage, an AC power supply having an amplitude of 50 V or less and a single frequency of or a superposed waveform of a plurality of frequency components of about 5 kHz to 2 MHz is used. By applying the auxiliary AC voltage, for the trapped ions, only ions (for example, sample molecular ions) of a specific mass number can be selected and the other ions can be eliminated, the ions of a specific mass number can be dissociated to create fragment ions, or the mass scan can be executed to deject certain ions mass-selectively. Especially, in the mass scan, by the auxiliary AC voltage applied across the linear ion trap electrodes 18*a* and 18*b*, sample molecular ions can be ejected through a slit 18*e* in the linear ion trap electrode 18*a* to a direction toward an ion detector 16 (in a direction of a flow 26 of mass-separated sample molecular ions) in a ascending order of the m/z value (mass number/charge number).

Subsequently, the ions ejected mass-selectively (ion ejection direction 26) are converted into electric signals by the ion detector 16 comprising an electron multiplier tube, a multichannel plate, or a conversion dynode, a scintillator, a photomultiplier, and the like; the electric signals are transmitted to the control circuit 21 so as to be accumulated (stored).

Figure 1C:
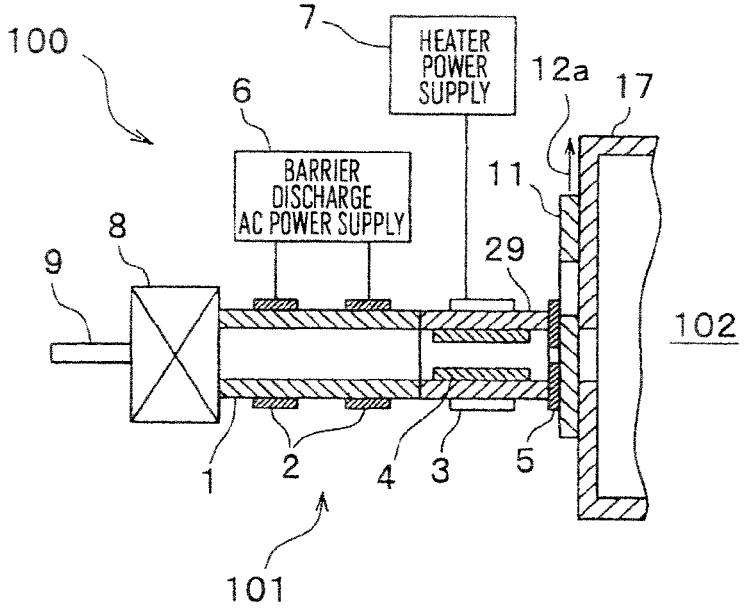
FIG. 1C is part of a configuration diagram showing a state in which a slide valve of the mass spectrometer according to the first embodiment of the present invention is closed.

Illustrated in FIG. 1C is a state that the slide valve 11 is closed in the mass spectrometer 100. The slide valve 11 is moved in a slide valve moving direction 12*a* to close the slide valve 11. Incidentally, in FIG. 1C, during the movement of the slide valve 11, the orifice 5, the sample container 29, and the like are not moved with respect to the vacuum chamber 17 but it is not limited therein. Namely, the slide valve 11, the orifice 5, the sample container 29, and the like may be coupled together and, when the slide valve 11 is moved, the orifice 5, the sample container 29, and the like may be moved linking together with the movement of the slide valve 11. With the slide valve 11 closed, the measurement of mass spectroscopy cannot be performed, then, but the sample 4 can be exchanged as a whole with the sample container 29 with different ones while maintaining high vacuum in the vacuum chamber 17.

Figure 1D:
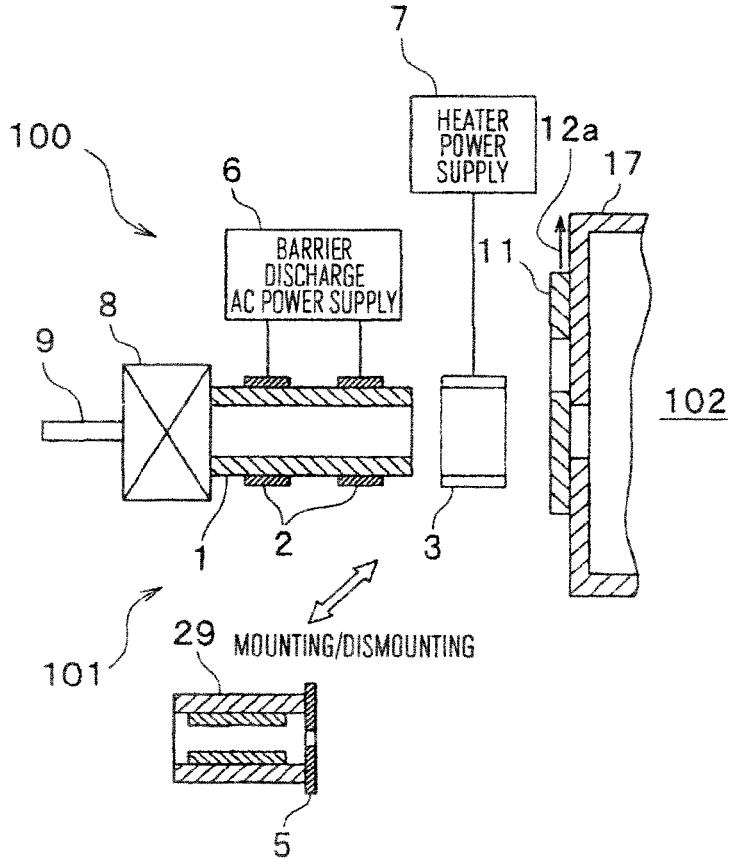
FIG. 1D is part of a configuration diagram showing the mass spectrometer according to the first embodiment of the present invention in mounting/dismounting a sample container with the slide valve closed.

The situation of the exchanging (mounting/dismounting) the sample container 29 with the slide valve 11 closed is shown in FIG. 1D. Preferably, the sample container 29 is mounted or dismounted while placing the slide valve 11 in a closed condition. The sample container 29 is separable from the dielectric container 1 and the heater 3. For the purpose of preventing contamination, the orifice 5 may be subjected to cleaning at the time of exchanging the sample container 29 or it may be integrated with the sample container 29 and exchanged together as shown in FIG. 1D. By making the sample container 29 and the orifice 5 integrated together, the orifice 5 can work as the bottom of the sample container 29 upon holding the sample 4, thus facilitating filling of the sample 4 and the orifice 5 will always be exchanged so that contamination can surely be prevented.

Figure 2:
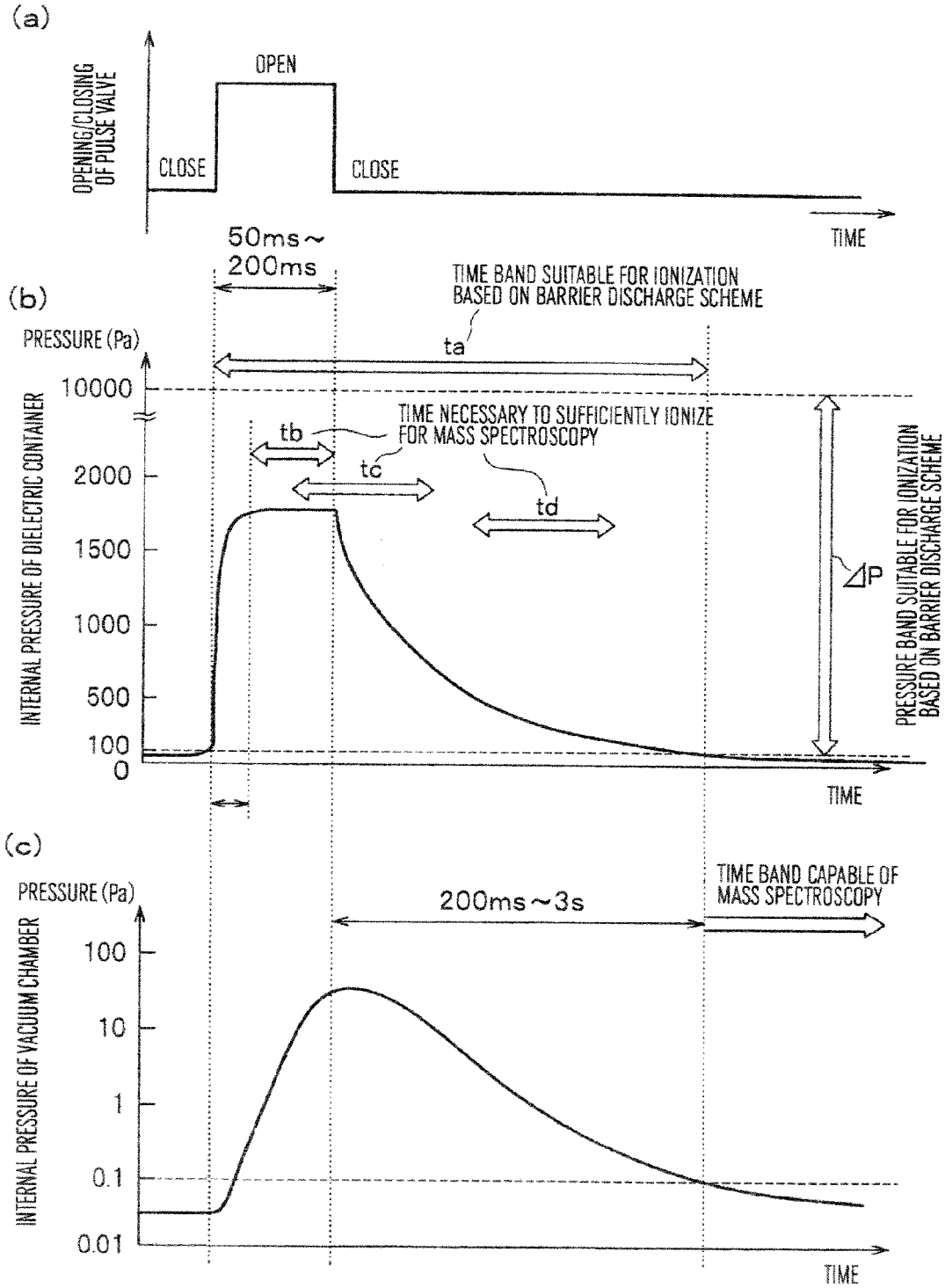
FIG. 2 is a graph showing a variation of an internal pressure in a dielectric container in part (b) and a variation of an internal pressure in the vacuum chamber in part (c) in accordance with a pulse valve open/close in part (a).

In FIG. 2, changes of the pressure in the dielectric container 1 (the ordinate of part (b) of FIG. 2) and the pressure in the vacuum chamber 17 (the ordinate of part (c) of FIG. 2) are shown along with opening/closing of the pulse valve 8 (refer to part (a) of FIG. 2). As the pulse valve 8 is opened, the pressure in the dielectric container 1 reaches a pressure suitable for ionization based on the barrier discharge scheme using the atmosphere as a discharge gas (for example, 1,700 to 1,800 Pa) in several tens of milliseconds with high reproducibility. Simultaneously, the pressure in the vacuum chamber 17 rises gradually to about 50 Pa. When the pulse valve 8 is closed subsequently, the pressure in the dielectric container 1 and that in the vacuum chamber 17 decrease gradually and after 200 ms to 3 s the pressure in the vacuum chamber 17 reaches a pressure (0.1 Pa or lower) at which the mass spectroscopy can be executed. In the present invention, by starting and ending the barrier discharge synchronously with the pressure value in the dielectric container 1, optimum ionization can be achieved. With the pulse valve 8 opened for a short time of 50 ms to 200 ms as shown in part (a) of FIG. 2, the pressure in the dielectric container 1 falls within a range of 100 Pa to 10,000 Pa which is a pressure band ΔP suitable for ionization based on the barrier discharge scheme as shown in part (b) of FIG. 2. The time for the pressure in the dielectric container 1 to stay in the pressure band ΔP corresponds to a time band ta suitable for ionization based on the barrier discharge scheme; within the time band ta, barrier discharge can be generated easily. Also, the time band ta suitable for the ionization based on the barrier discharge scheme is longer than times tb, tc, and td which are times necessary for ionization of reactant ions needed to secure sample molecular ions sufficient for mass spectroscopy. The times tb, tc, and td necessary to sufficiently ionize reactant ions can be set arbitrarily, provided that they fall in the time band ta suitable for ionization based on the barrier discharge scheme. For instance, like the time tb, the time tb may end synchronously with the closure of the pulse valve 8. Also, the time may be so set as to cross over the closure time of the pulse valve 8 like the time tc or the time may be so set after the closure of the pulse valve 8 like the time td. The control circuit 21 operates to generate a barrier discharge during the set time tb, tc, or td. In the barrier discharge, an AC voltage of several kV at several MHz supplied from the barrier discharge AC power supply 6 is applied across the two barrier discharge electrodes 2 arranged outside of the dielectric container 1 to generate the barrier discharge in the barrier discharge region 10. Water ($H_2O$) and oxygen molecules ($O_2$) contained in the atmosphere passing through the barrier discharge region 10 are changed by the barrier discharge to reactant ions such as $H_3O^+$ and $O_2^-$ and move to the sample container 29 in which the sample 4 is arranged (flow of the reactant ion 24).

In addition, as shown in part (c) of FIG. 2, the control circuit 21 monitors the vacuum gauge 15 and starts mass spectroscopy after the pressure in the vacuum chamber 17 sufficiently decreases to reach 0.1 Pa or lower so that proper mass spectroscopy is realized.

Figure 3:
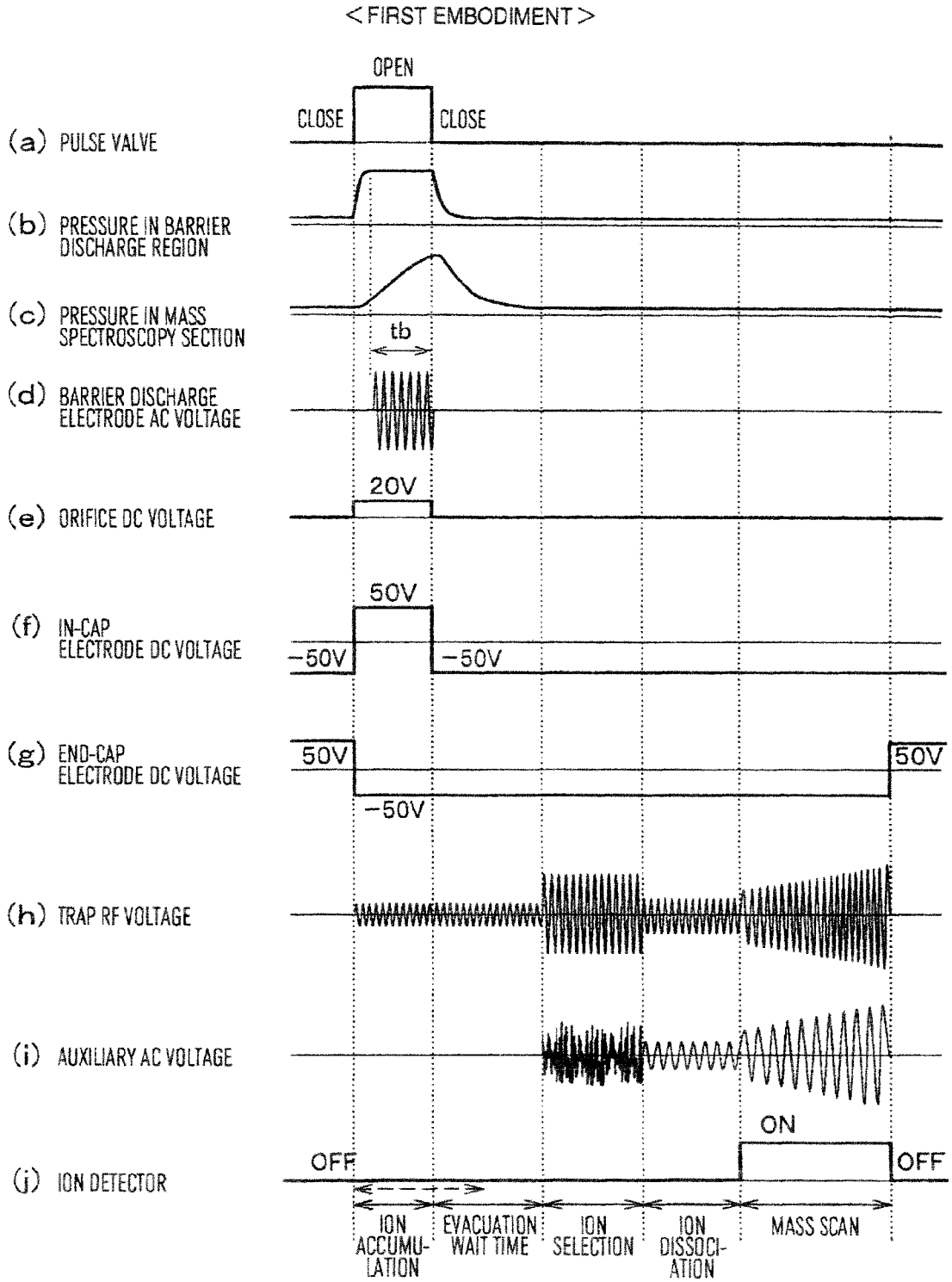
FIG. 3 is a graph showing open/close of the pulse valve in part (a), a pressure in a barrier discharge region in part (b), a pressure in the mass spectroscopy section in part (c), an alternating-current (AC) voltage across barrier discharge electrodes in part (d), an orifice DC voltage in part (e), an in-cap electrode DC voltage in part (f), an end-cap electrode DC voltage in part (g), a trap RF voltage in part (h), an auxiliary AC voltage in part (i), and on/off of an ion detector in part (j) corresponding to a sequence (ion accumulation—evacuation wait time—ion selection—ion dissociation—mass scan) of a method of a mass spectroscopy (voltage sweep scheme) in the mass spectrometer according to the first embodiment of the present invention.

In FIG. 3, corresponding to a sequence (ion accumulation—evacuation wait time—ion selection—ion dissociation—mass scan) of a method of a mass spectroscopy (voltage sweep scheme) in the mass spectrometer 100 of the first embodiment of the present invention, the open/close of the pulse valve in part (a), the pressure in the barrier discharge region in part (b), the pressure in the mass spectroscopy section in part (c), the AC voltage across the barrier discharge electrodes in part (d), the orifice DC voltage in part (e), the in-cap electrode DC voltage in part (f), the end-cap electrode DC voltage in part (g), the trap RF voltage in part (h), the auxiliary AC voltage in part (i), and the on/off of the ion detector in part (j) are shown. As shown in FIG. 3, the sequence of the mass spectroscopy includes five steps of ion accumulation, evacuation wait (time), ion selection, ion dissociation, and mass scan. Incidentally as described in connection with FIG. 2, the ion accumulation step and the evacuation wait (time) step may proceed simultaneously and overlap with each other in time.

(Ion Accumulation Step)

First, as shown in part (a) of FIG. 3, the pulse valve 8 is opened. Then, as shown in parts (b) and (c) of FIG. 3, the pressure in the barrier discharge region 10 (dielectric container 1) and the pressure in the mass spectroscopy section 102 rise. As shown in part (d) of FIG. 3, in timing with the pressure in the barrier discharge region 10 (dielectric container 1) rising up to an appropriate value, an AC voltage of several kV at several MHz is applied by the barrier discharge AC power supply 6 to the barrier discharge electrodes 2, thereby generating barrier discharge. Concurrently with the opening of the pulse valve 8, as seen in parts (e) and (f) of FIG. 3, appropriate bias voltages (for example, 20 V (refer to part (e) of FIG. 3) and 50 V (refer to (f) in FIG. 3)) are applied to the orifice 5 and the in-cap electrode 19, respectively, and generated sample molecular ions are led to the interior of the mass spectroscopy section 102. On the assumption that the sample molecular ions to be measured are negative ions, 20 V and 50 V are applied to the orifice 5 and the in-cap electrode 19, respectively, in parts (e) and (f) of FIG. 3. Further as shown in parts (g) and (h) of FIG. 3, by an electrostatic field generated as applying −50 V to the end-cap electrode 20 and a radio-frequency electric field generated as applying an RF voltage of several MHz to the linear ion trap electrodes 18*a*, 18*b*, 18*c*, and 18*d*, the sample molecular ions guided to the interior of the mass spectroscopy section 102 are trapped (accumulated) linearly in the central region of the mass spectroscopy section 102.

In the timing when a sufficient amount of sample molecular ions is trapped, application of the voltage by the barrier discharge AC power supply 6 is stopped as shown in part (d) of FIG. 3 to cease the barrier discharge. Further, the polarity of the voltage on the in-cap electrode 19 is switched over (from 50 V to −50 V) as shown in part (f) of FIG. 3 to prevent the sample molecular ions trapped in the mass spectroscopy section 102 from escaping toward the in-cap electrode 19. Incidentally, the pulse valve 8 may be closed as shown in part (a) of FIG. 3 in the timing of ceasing the barrier discharge as shown in part (d) of FIG. 3 but, as it has already been described in connection with FIG. 2, they are not always needed to be coincident. Namely, as indicated by a dotted-line arrow in part (j) of FIG. 3, the ion accumulation step may overlap with the evacuation wait step.

(Evacuation Wait Step)

In the evacuation wait step, a process flow stays on hold after the pulse valve 8 is placed in the closed condition until the pressure in the vacuum chamber 17 falls to 0.1 Pa or lower at which execution of the mass spectroscopy is possible. Waiting takes about 1 to 3 seconds until the pressure in the vacuum chamber 17 falls to 0.1 Pa or lower. The pressure in the vacuum chamber 17 is monitored with the vacuum gauge 15.

(Ion Selection Step)

In the ion selection step, in order to select sample molecular ions (target ions) of m/z values within a specific range out of the trapped ions, an auxiliary AC voltage is applied across the linear ion trap electrodes 18*a* and 18*b* as shown in part (i) of FIG. 3 and the trap RF voltage is raised as shown in part (h) of FIG. 3 so that a FNF (Filtered Noise Field) process is carried out and sample molecular ions not having m/z values within the range desired to be measured are expelled from the trap region. Incidentally, the FNF process is omitted in case where all the trapped sample molecular ions are to be subjected to mass separation.

(Ion Dissociation Step)

In the ion dissociation step, a CID (Collision Induced Dissociation) process is applied to the sample molecular ions to generate product ions. As shown in part (i) of FIG. 3, an auxiliary AC voltage corresponding to a m/z value of a precursor ion (target ion) as a target of the CID is applied across the linear ion trap electrodes 18*a* and 18*b* to cause the precursor ion to collide with neutral molecules ($N_2$, and/or $O_2$) existing in the mass spectroscopy section 102 to thereby fragment (dissociate) (creation of fragment ions). The precursor ions resonate with the auxiliary AC voltage and are subjected to multi-collisions with neutral molecules (buffer gas) in the trap, thus being decomposed and creating fragment ions. Preferably, the buffer gas has a pressure of about 0.01 to 1 Pa. When the mass separation of the product ions is not needed, the CID process can be omitted.

(Mass Scan Step)

Finally, as shown in parts (h) and (i) of FIG. 3, voltage values (peak values) of the trap RF voltage and the auxiliary AC voltage are swept in order that ions are ejected from the slit 18*e* of the linear ion trap electrode 18*a* in a direction to the ion detector 16 in an ascending order of the m/z value. Differences in detection timing at the ion detector 16 caused by differences in the m/z value are recorded in the form of a MS spectrum of mass spectroscopy. In other words, from ion mass numbers and signal quantities of detected ions, a mass spectroscopic spectrum can be obtained. In the mass scan step, the voltage of the ion detector 16 must be turned on as shown in part (j) of FIG. 3. Incidentally, a high voltage which needs to be stabilized in time is typically used as the voltage for the ion detector 16 and it may be turned on during the ion selection step or the ion dissociation step. This is because the ion detector 16 is supposed to be one to which a high voltage cannot be applied in an environment of a high pressure region such as an electron multiplier; when a photomultiplier, a semiconductor detector, or the like is used as the ion detector 16, the voltage for the ion detector 16 can be left on constantly during operation of the spectrometer and the on/off switching operation can be omitted.

MS/MS measurement is carried out in the aforementioned five steps of the ion accumulation, the evacuation wait, the ion selection, the ion dissociation, and the mass scan; in case of a usual MS measurement, the selection step and the dissociation step can be omitted. To perform the MS/MS spectroscopy plural times ($MS^n$), the selection step and the dissociation step may be repeated plural times.

Variation of First Embodiment

Figure 4:
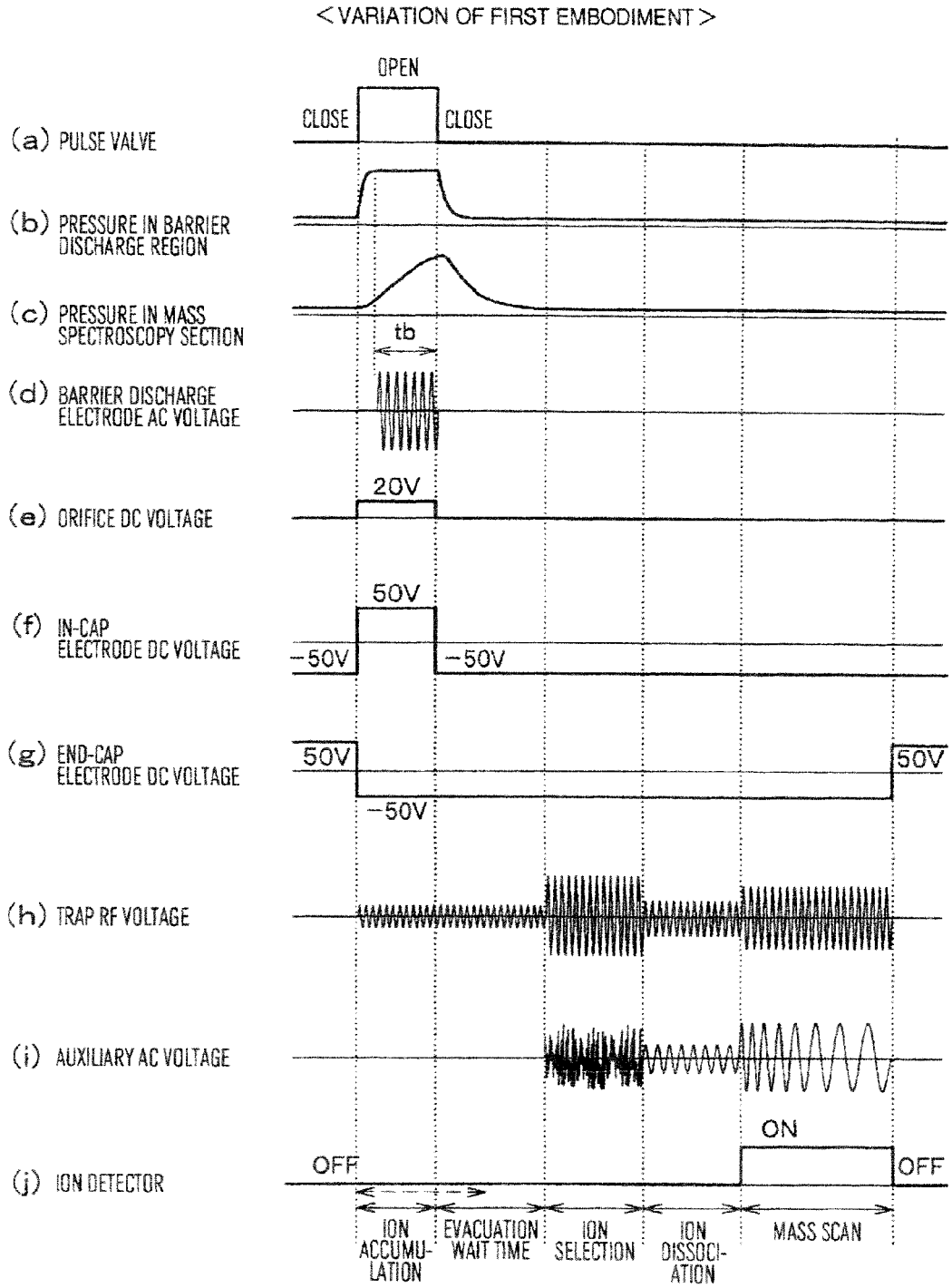
FIG. 4 is a graph showing open/close of the pulse valve in part (a), the pressure in the barrier discharge region in part (b), the pressure in the mass spectroscopy section in part (c), the AC voltage across the barrier discharge electrodes in part (d), the orifice DC voltage in part (e), the in-cap electrode DC voltage in part (f), the end-cap electrode DC voltage in part (g), the trap RF voltage in part (h), the auxiliary AC voltage in part (i), and on/off of the ion detector in part (j) corresponding to a sequence of a method of a mass spectroscopy (frequency sweep scheme) in a mass spectrometer according to a variation of the first embodiment of the present invention

In FIG. 4, corresponding to a sequence of a method of a mass spectroscopy (frequency sweep scheme) in a mass spectrometer 100 according to a variation of the first embodiment of the present invention, the open/close of the pulse valve in part (a), the pressure in the barrier discharge region in part (b), the pressure in the mass spectroscopy section in part (c), the AC voltage across the barrier discharge electrodes in part (d), the orifice DC voltage in part (e), the in-cap electrode DC voltage in part (f), the end-cap electrode DC voltage in part (g), the trap RF voltage in part (h), the auxiliary AC voltage in part (i), and the on/off of the ion detector in part (j) are shown. The variation of the first embodiment differs from the first embodiment in the mass scan step. In the first embodiment, the voltage values (peak values) of the trap RF voltage and the auxiliary AC voltage are swept as shown in parts (h) and (i) of FIG. 3; in the variation, however, the frequency of the auxiliary AC voltage is swept as shown in part (i) of FIG. 4 while the voltage value and the frequency of the trap RF voltage are kept constant as shown in part (h) of FIG. 4. Even in the frequency sweep scheme of the variation, ions are ejected in an ascending order of the m/z value from the slit 18*e* of the linear ion trap electrode 18*a* in a direction toward the ion detector 16.

Figure 5:
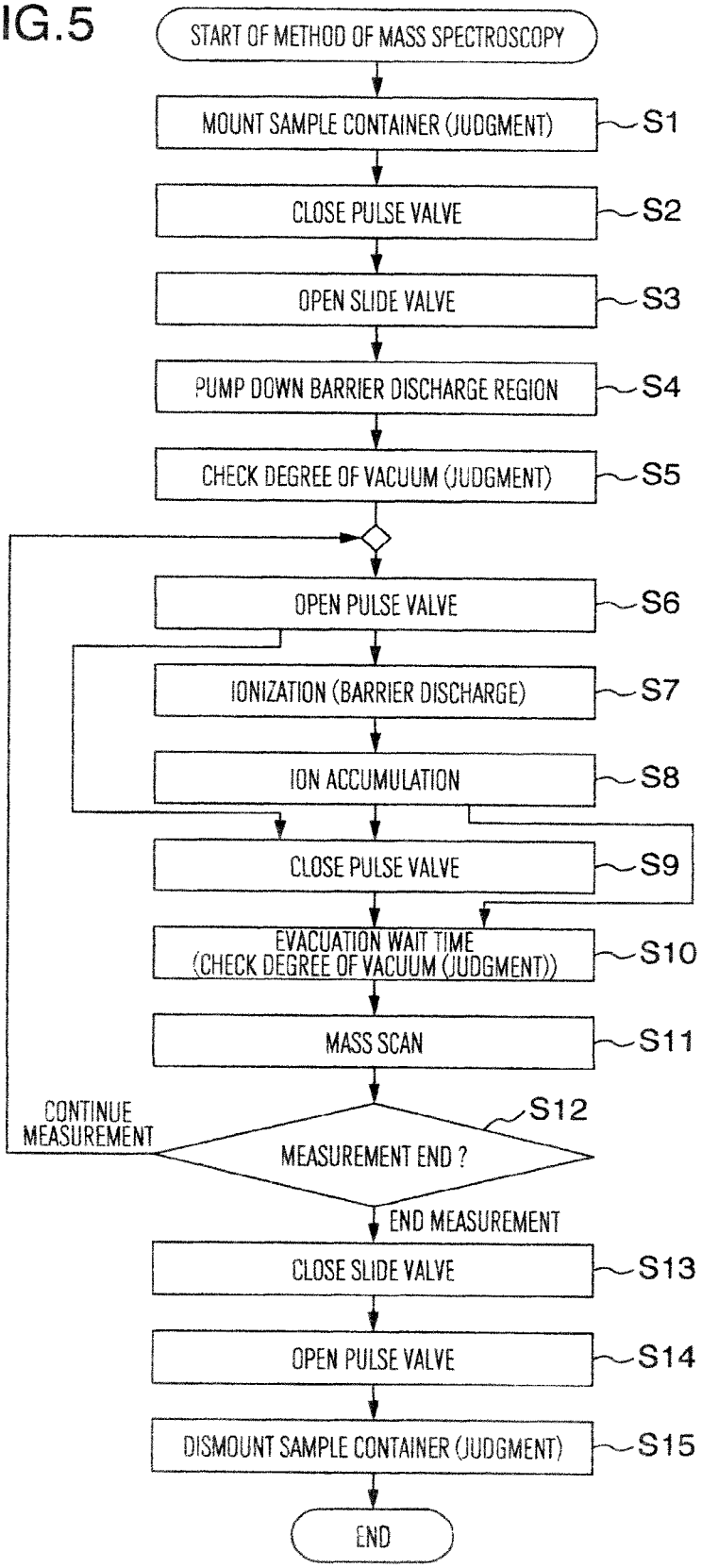
FIG. 5 is a flowchart of a method of a mass spectroscopy carried out in the mass spectrometer according to the first embodiment of the present invention.

In FIG. 5, a flowchart of the method of mass spectroscopy carried out in the mass spectrometer 100 according to the first embodiment of the present invention is shown.

First, an operator mounts a sample container containing a sample 4 to the mass spectrometer 100 (Step S1). Then, the control circuit 21 of the mass spectrometer 100 judges if a sample container 29 is mounted. When a sample container 29 is judged to be mounted, the process flow proceeds to Step S2; it does not proceed to Step S2 until a sample container 29 is judged to be mounted.

Next, the control circuit 21 closes the pulse valve 8 (Step S2). Thereafter, the control circuit 21 opens the slide valve 11 (Step S3). With these steps the dielectric container 1 forming a barrier discharge region and the sample container 29 are differentially pumped through the orifice 5 (Step S4). The control circuit 21 monitors a degree of vacuum (change) inside the vacuum chamber 17 with the vacuum gauge 15 to make a judgment as to whether the barrier discharge region 10 is sufficiently evacuated (Step S5). Specifically, it is judged if the degree of vacuum inside the vacuum chamber 17 reaches a predetermined degree of vacuum or better. Then, when it is judged that the degree of vacuum inside the vacuum chamber 17 has reached the predetermined degree of vacuum or better, the process flow proceeds to Step S6; it does not proceed to Step S6 until it is judged that it has reached.

Subsequently, in order to initiate measurement, the pulse valve 8 is opened (Step S6). The process flow proceeds from Step S6 to Steps S7 and S9. To Steps S7 and S9 the process flow proceeds when predetermined time periods elapse which are determined respectively. At Step S7, the control circuit 21 generates reactant ions by generating barrier discharge in the dielectric container 1 and generates sample molecular ions in the sample container 29 by causing ion molecular reactions to occur. The control circuit 21 leads the generated sample molecular ions to the central region of the mass spectroscopy section 102 by way of the orifice 5 and the in-cap electrode 19 so as to trap them in the mass spectroscopy section 102 (Step S8). Step S7 is executed for a predetermined time during which the sample molecular ions are sufficiently trapped and Step S8 is executed synchronously with Step S7.

At Step S9, the control circuit 21 closes the pulse valve 8 once a predetermined time has elapsed after opening of the pulse valve 8 at Step S6. The control circuit 21 waits for 1 to 3 seconds until the pressure in the mass spectroscopy section 102 falls sufficiently (Step S10). Specifically, the control circuit 21 monitors the degree of vacuum (change) inside the vacuum chamber 17 with the vacuum gauge 15 to make a judgment as to whether the degree of vacuum inside the vacuum chamber 17 reaches a predetermined degree of vacuum or better. Then, when it is judged that the degree of vacuum (pressure) inside the vacuum chamber 17 has reached the predetermined degree of vacuum or better, the process flow proceeds to Step S11; it does not proceed to Step S11 until it is judged that it has reached.

At Step S11, the control circuit 21 carries out the ion selection, the ion dissociation, and the mass scan and stores measurement results.

At Step S12, a judgment is made based on an input from the operator or the like as to whether measurements of the identical sample 4 are to be ended. If measurements of the identical sample 4 do not end and a different measurement continues with the identical sample 4, the process flow returns to the step of opening the pulse valve 8 (Step S6) and a measurement is carried out again. This ensures that repetitive mass spectroscopy of the sample 4 can be conducted. When the measurements end, the process flow proceeds to Step S13 at which the slide valve 11 is closed. The control circuit 21 opens the pulse valve 8 (Step S14) and restores the pressure in the sample container 29 to the atmospheric pressure. The operator dismounts the sample container 29 containing the sample 4 from the mass spectrometer 100 (Step S15). Then, the control circuit 21 judges whether the sample container 29 is dismounted. When the sample container 29 is judged to be dismounted, this process flow comes to end; the process flow is not allowed to end until the dismount of the sample container 29 is asserted. When a different sample 4 is to be measured, the process flow may start from the step of mounting the sample container 29 (Step S1) again.

Second Embodiment

Figure 6A:
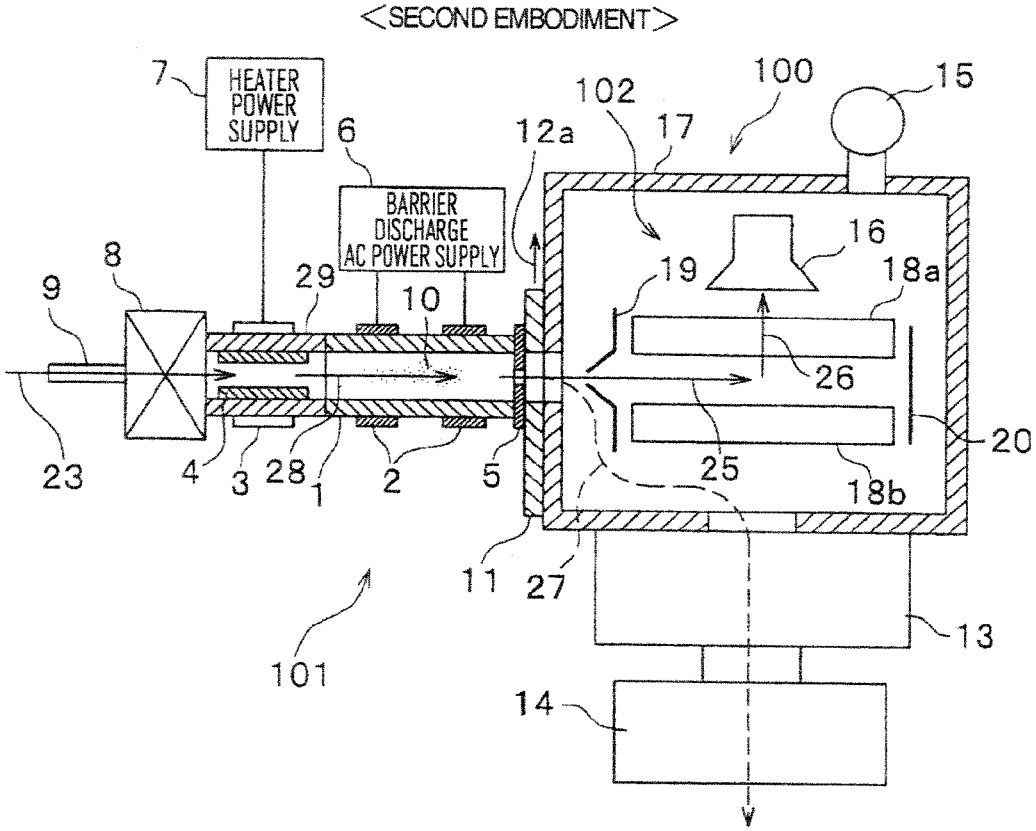
FIG. 6A is a configuration diagram of a mass spectrometer according to a second embodiment of the present invention.

In FIG. 6A, a configuration diagram of a mass spectrometer 100 according to a second embodiment of the present invention is shown. The mass spectrometer 100 of the second embodiment differs from the mass spectrometer 100 of the first embodiment in that the order of layout of the dielectric container 1 and the sample container 29 is reversed. That is, the sample container 29 is arranged on the downstream side of the flow of atmosphere (air) 23 and the flow of the sample molecules (gas) 28 with respect to the pulse valve 8 and the capillary 9 similarly to the case of the first embodiment but is arranged on the upstream side of the flow of atmosphere (air) 23 and the flow of the sample molecules (gas) 28 with respect to the ion source 101 (dielectric container 1).

Figure 6B:
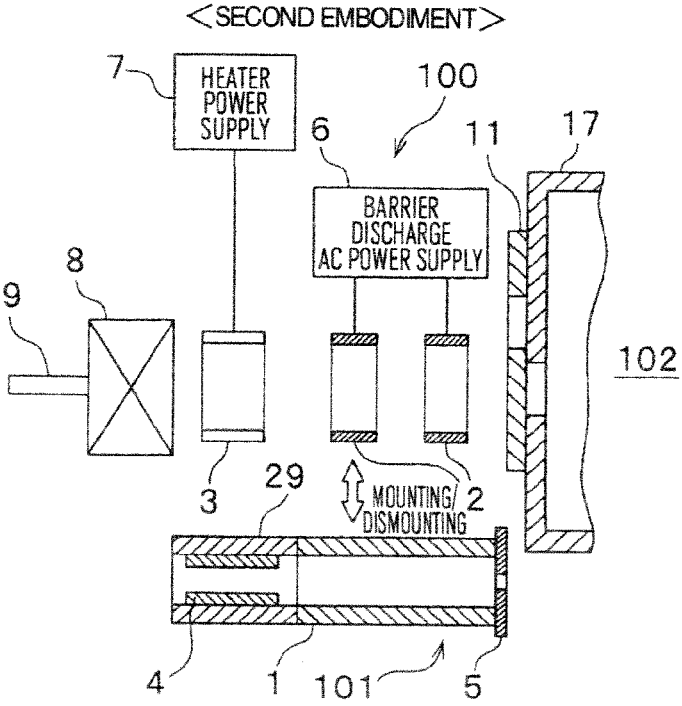
FIG. 6B is part of a configuration diagram showing the mass spectrometer according to the second embodiment of the present invention when the sample container and a dielectric container are mounted/dismounted with the slide valve closed.

In the first embodiment, water ($H_2O$) and oxygen molecules ($O_2$) in the atmosphere (air) introduced from the capillary 9 are ionized in the barrier discharge region 10 into reactant ions and the reactant ions undergo ion molecular reactions with the vaporized sample 4 to generate the sample molecular ions. Contrary to this, in the second embodiment, the vaporized sample 4 can also pass through the barrier discharge region 10 and, therefore, can be ionized directly in the barrier discharge region 10. Consequently, more sample molecular ions can be generated than in the first embodiment. Further, since in the second embodiment the barrier discharge region 10 for generating ions is positioned closer to the orifice 5 which is in communication with the mass spectroscopy section 102 than in the first embodiment, transport loss of the generated ions can be reduced. When the vaporized sample 4 is ionized directly with the barrier discharge, however, fragmentation (division of sample molecules) may occur; the first embodiment is preferred if fragmentation tends to occur. Moreover, there is a possibility that the dielectric container 1 may also be contaminated by the vaporized sample 4 and/or the sample molecular ions and, therefore, the dielectric container 1 also needs to be exchanged as shown in FIG. 6B when the sample 4 is exchanged along with the sample container 29. For this purpose, the sample container 29 is made integral with the dielectric container (dielectric bulkhead) 1 and can be mounted and dismounted together as being coupled with each other.

Variation 1 of Second Embodiment

Figure 6C:
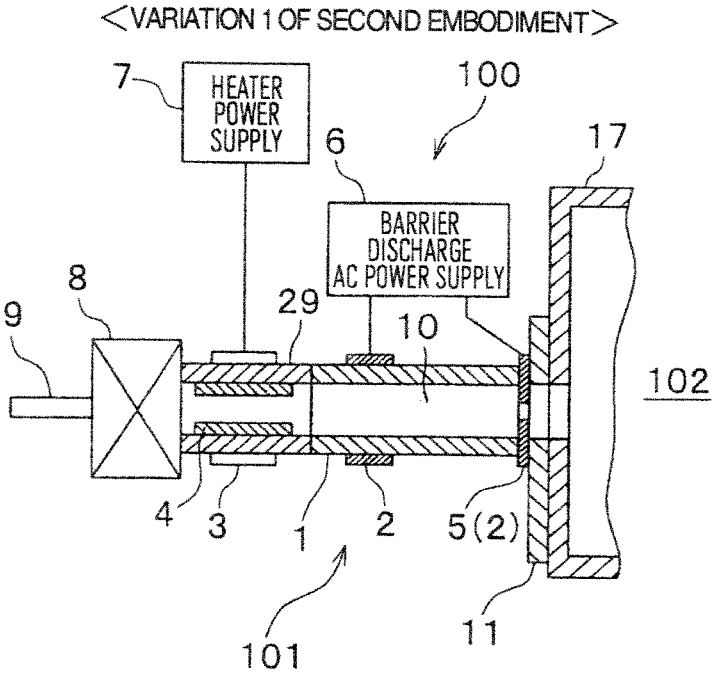
FIG. 6C is part of a configuration diagram showing a mass spectrometer according to Variation 1 of the second embodiment of the present invention.

Illustrated in FIG. 6C is part of a mass spectrometer 100 according to Variation 1 of the second embodiment of the present invention. In Variation 1 of the second embodiment, the orifice 5 serves also as one of the barrier discharge electrodes 2 for generation of the barrier discharge region 10. This not only simplifies the structure but also the barrier discharge region 10 can be made closer to the orifice 5 to reduce the transport loss of the generated ions by exposing the orifice 5 to the internal space of the dielectric container 1, that is to the barrier discharge region 10 in other words.

Variation 2 of Second Embodiment

Figure 6D:
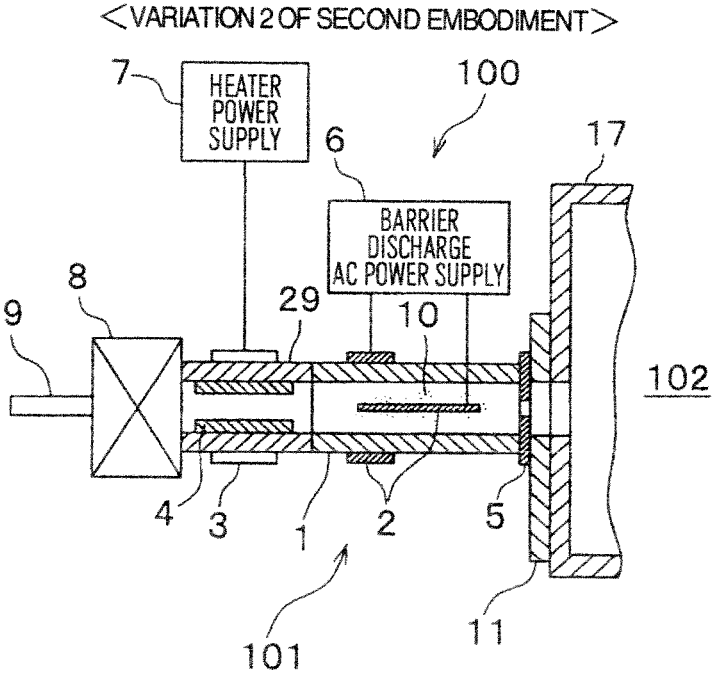
FIG. 6D is part of a configuration diagram showing a mass spectrometer according to Variation 2 of the second embodiment of the present invention.

Illustrated in FIG. 6D is part of a mass spectrometer 100 according to Variation 2 of the second embodiment of the present invention. In Variation 2 of the second embodiment, one of the barrier discharge electrodes 2 for generation of the barrier discharge region 10 is arranged in the internal space of the dielectric container 1 and exposed thereto; that is, it is arranged in the barrier discharge region 10 and exposed thereto. This can also generate the barrier discharge region 10. In addition, Variation 2 of the second embodiment can be applied not only to the second embodiment but also to the first embodiment and a third embodiment to be described later as well.

Variation 3 of Second Embodiment

Figure 6E:
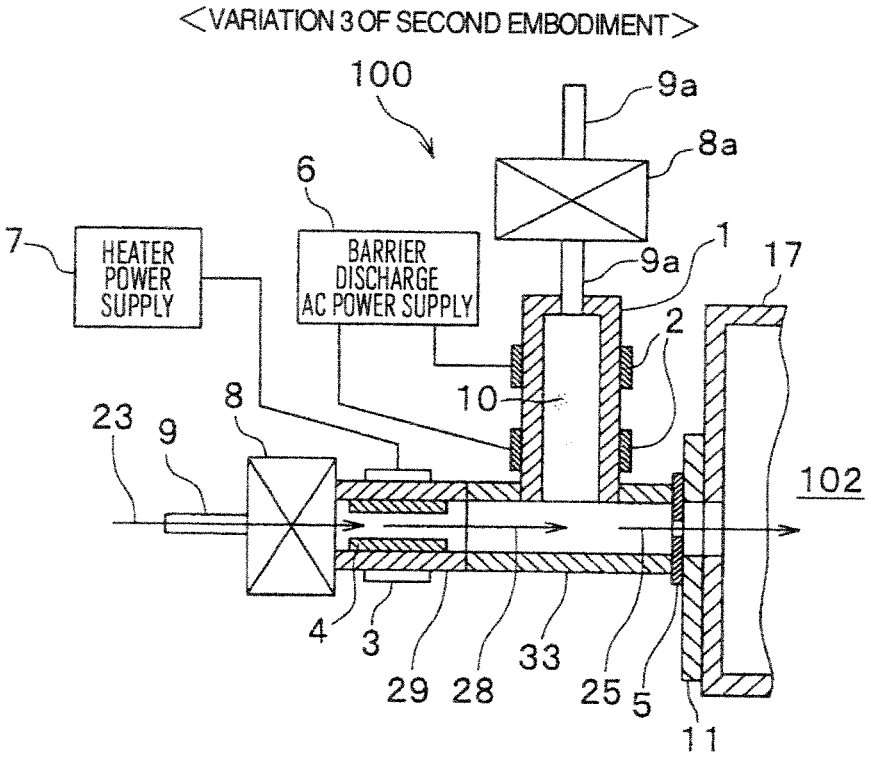
FIG. 6E is part of a configuration diagram showing a mass spectrometer according to Variation 3 of the second embodiment of the present invention.

Illustrated in FIG. 6E is part of a mass spectrometer 100 according to Variation 3 of the second embodiment of the present invention. The mass spectrometer 100 of Variation 3 of the second embodiment differs from the mass spectrometer 100 of the second embodiment in that the barrier discharge region 10 is not generated on the flow of sample molecules (gas) 28. Accordingly, in Variation 3 of the second embodiment, a sample ionization container 33 is provided. The sample ionization container 33 is cylindrical, arranged at the position where the dielectric container 1 is arranged in the second embodiment, that is the position between the orifice 5 and the sample container 29, and connected to the orifice 5 and the sample container 29. Then, a cylindrical dielectric container 1 is connected to the side wall of the sample ionization container 33. An extension line of the central axis of the cylindrical dielectric container 1 orthogonally crosses the central axis of the cylindrical sample ionization container 33. The dielectric container 1 is connected with a capillary 9*a* and a pulse valve 8*a*.

The pulse valve 8*a* is opened and closed synchronously with the pulse valve 8 so that the atmosphere (water and oxygen molecules) can be introduced to the interior of the dielectric container 1 through the capillary 9*a* and the pulse valve 8*a*. Water and oxygen molecules in the introduced atmosphere are ionized in the barrier discharge region 10 inside the dielectric container 1 into reactant ions. The reactant ions generated in the barrier discharge region 10 inside the dielectric container 1 move to the sample ionization container 33 due to pressure difference. Sample molecules flowing in from the sample container 29 along with the flow of sample molecules (gas) 28 undergo ion molecular reactions with the reactant ions coming from the dielectric container 1 in the sample ionization container 33, thus generating sample molecular ions. The generated sample molecular ions form a flow of sample molecular ions 25 and enter the vacuum chamber 17 from the sample ionization container 33 by way of the orifice 5. With this configuration, since the barrier discharge region 10 is separated from the flow of sample molecules (gas) 28, the vaporized sample 4 is not ionized directly in the barrier discharge region 10 and the sample molecular ions can be generated through ion molecule reactions with the reactant ions of water and oxygen molecules in the atmosphere which are ionized in the barrier discharge region 10 similarly to the case of the first embodiment. In addition, Variation 3 of the second embodiment can be applied not only to the second embodiment but also to the first embodiment and the third embodiment to be described later as well. It would be appreciated that the capillary 9*a* and the pulse valve 8*a* may be omitted and this holds true in the following description.

Variation 4 of Second Embodiment

Figure 6F:
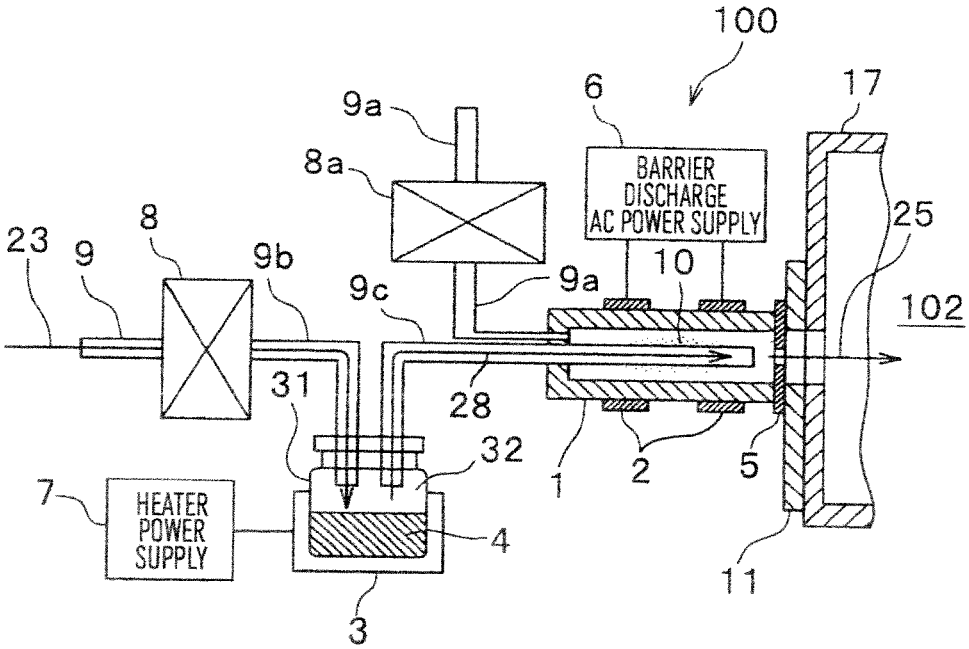
FIG. 6F is part of a configuration diagram showing a mass spectrometer according to Variation 4 of the second embodiment of the present invention.

Illustrated in FIG. 6F is part of a mass spectrometer 100 according to Variation 4 of the second embodiment of the present invention. Like the second embodiment, the sample 4 is also disposed between and connected with the pulse valve 8 and the dielectric container 1 in Variation 4 of the second embodiment; unlike the second embodiment, however, the sample 4 is put in a vial 31 in Variation 4 of the second embodiment. In a head space region 32 above the sample 4 in the vial 31, the sample 4 is vaporized to generate its gas. The head space region 32 and the pulse valve 8 are interconnected by a capillary 9*b*. Further, the head space region 32 and the dielectric container 1 are interconnected by a capillary 9*c*. One end of the capillary 9*c* is inserted into the internal space of the dielectric container 1 through its wall surface opposing the orifice 5 and reaches near the orifice 5 across the barrier discharge region 10. The capillary 9*c* is cylindrical and its central axis coincides with the central axis of the cylindrical dielectric container 1; the orifice 5 is located on an extension of the central axis of the capillary 9*c*. It should be understood that the capillary 9*c* is shielded and grounded so that a radio frequency electromagnetic wave radiated from the barrier discharge electrodes 2 will not transmit into its interior.

According to the head space scheme, a flow of atmosphere 23 is generated so that the atmosphere flows into the head space region 32 by way of the capillary 9, the pulse valve 8, and the capillary 9*b* when the pulse valve 8 is opened. The atmosphere further flows out of the capillary 9*c* together with the gas of the vaporized sample 4 to generate a flow of gas (sample molecules) 28. The gas into which the sample 4 vaporizes passes through the capillary 9*c* without being exposed directly to the barrier discharge region 10 or ionized by its own discharge and flows out of the end of the capillary 9*c* to the interior of the dielectric container 1 immediately before the orifice 5. Also in Variation 3 of the second embodiment, no barrier discharge region 10 is generated on the flow of sample molecules (gas) 28 and the sample molecules (gas) are not exposed to the barrier discharge region 10.

The capillary 9*a* and the pulse valve 8*a* are connected to a wall opposing the orifice 5 or a wall near it (a wall not confronting the barrier discharge region 10) of the dielectric container 1. The pulse valve 8*a* is opened and closed synchronously with the pulse valve 8 so that the atmosphere (water and oxygen molecules) can be introduced to the interior of the dielectric container 1 by way of the capillary 9*a* and the pulse valve 8*a*. Water and oxygen molecules in the introduced atmosphere are ionized into reactant ions in the barrier discharge region 10 inside the dielectric container 1. The reactant ions generated in the barrier discharge region 10 inside the dielectric container 1 move to a neighborhood of one end of the capillary 9*c* due to pressure difference and further to the interior of the dielectric container 1 immediately before the orifice 5. Then, in the interior of the dielectric container 1 immediately before the orifice 5, the gas (sample molecules) flowing in from the capillary 9*c* along with the flow of sample molecule (gas) 28 undergoes ion molecular reactions with the reactant ions, thus generating sample molecule ions. The generated sample molecule ions form a flow of sample molecular ions 25 which in turn flows in from the dielectric container 1 into the vacuum chamber 17 through the orifice 5.

As described above, in Variation 4 of the second embodiment, the atmosphere caused by the open/close operation of the pulse valve 8 to flow into the head space region 32 inside the vial 31 through the capillaries 9 and 9*b* forces out the sample 4 vaporized in the head space region 32 which in turn is led to the downstream side with respect to the barrier discharge region 10 through the capillary 9*c*. The vaporized sample 4 will not be ionized directly in the barrier discharge region 10 and the sample molecular ions can be generated in ion molecular reactions with the reactant ions of water and oxygen molecules in the atmosphere which are ionized in the barrier discharge region 10 similarly to the case of the first embodiment. Further, in case where the sample 4 is a liquid containing lots of contaminants, an influence of the contaminants can be reduced with the head space scheme as above.

Variation 5 of Second Embodiment

Figure 6G:
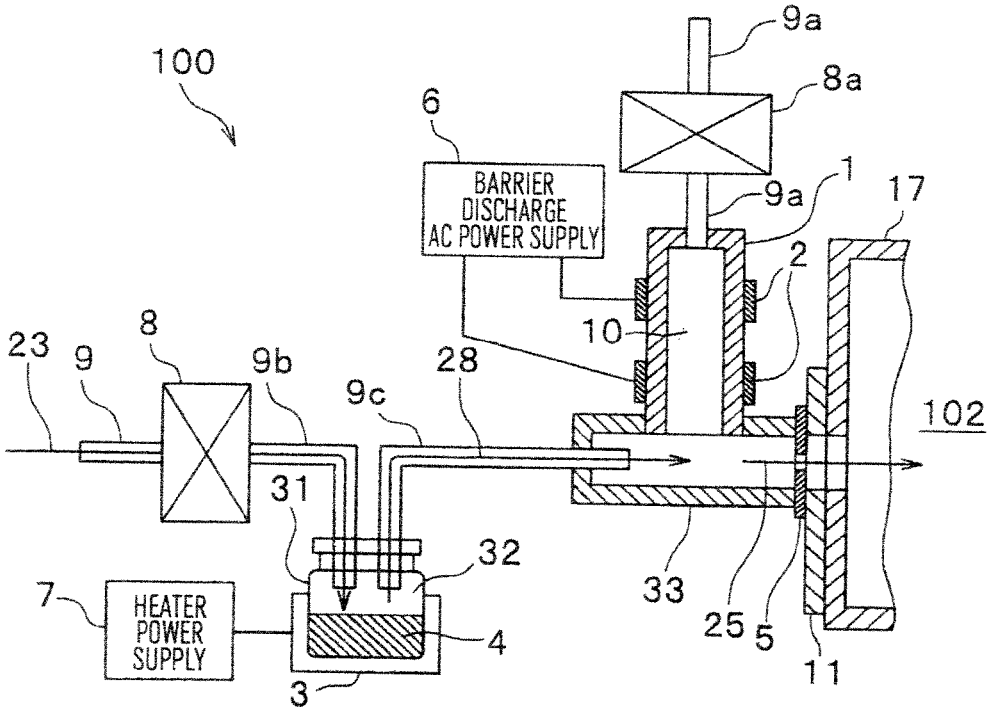
FIG. 6G is part of a configuration diagram showing a mass spectrometer according to Variation 5 of the second embodiment of the present invention.

Illustrated in FIG. 6G is part of a mass spectrometer 100 according to Variation 5 of the second embodiment of the present invention. The mass spectrometer 100 of Variation 5 of the second embodiment differs from the mass spectrometer 100 of Variation 3 of the second embodiment in that a sample 4 is put in a vial 31. A head space scheme using the vial 31 is similar to Variation 4 of the second embodiment but the capillary 9*c* is connected to a sample ionization container 33 in Variation 5 differently from in Variation 4 in which it is connected to the dielectric container 1. No barrier discharge region 10 is generated in the sample ionization container 33 and, therefore, the flow of sample molecules (gas) 28 does not thrust into a barrier discharge region 10 when the flow of sample molecules (gas) 28 enters into the sample ionization container 33. Further, since no barrier discharge region 10 is generated in the sample ionization container 33, one end of the capillary 9*c* inside the sample ionization container 33 can basically be positioned at any spot on the central axis of the sample ionization container 33; for the purpose of improving the efficiency of ion molecular reactions, it is desirable to position the end further away from the orifice 5 than the position at which the dielectric container 1 connects.

Also according to Variation 5 of the second embodiment, the barrier discharge region 10 is separated from the flow of sample molecules (gas) 28, the vaporized sample 4 is not ionized directly in the barrier discharge region 10 and the sample molecular ions can be generated through ion molecular reactions with reactant ions of water and oxygen molecules in the atmosphere which are ionized in the barrier discharge region 10 similarly to the case of the first embodiment.

Variation 6 of Second Embodiment

Figure 6H:
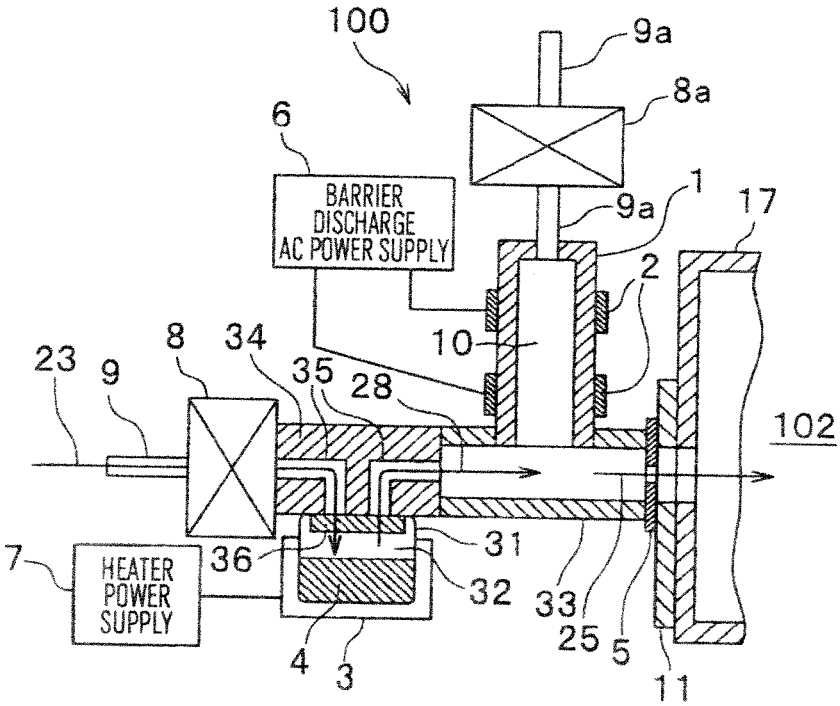
FIG. 6H is part of a configuration diagram showing a mass spectrometer according to Variation 6 of the second embodiment of the present invention.

Illustrated in FIG. 6H is part of a mass spectrometer 100 according to Variation 6 of the second embodiment of the present invention. The mass spectrometer 100 of Variation 6 of the second embodiment differs from the mass spectrometer 100 of Variation 5 of the second embodiment in that a cap 34 embedded and integrated with thin pipes 35 in place of the capillaries 9*b* and 9*c* is used to interconnect the pulse valve 8, the vial 31, and the sample ionization container 33. With this configuration, exchange of the vial 31 can be facilitated as compared to the case of interconnection with the help of the capillaries 9*b* and 9*c*. Besides, at their ends of the thin pipes 35 of the cap 34 towards the vial 31*a* porous filter 36 adapted to pass only gas therethrough is provided to thereby prevent liquid and powder (solid material) from entering the thin pipes 35 of the cap 34.

Third Embodiment

Figure 7A:
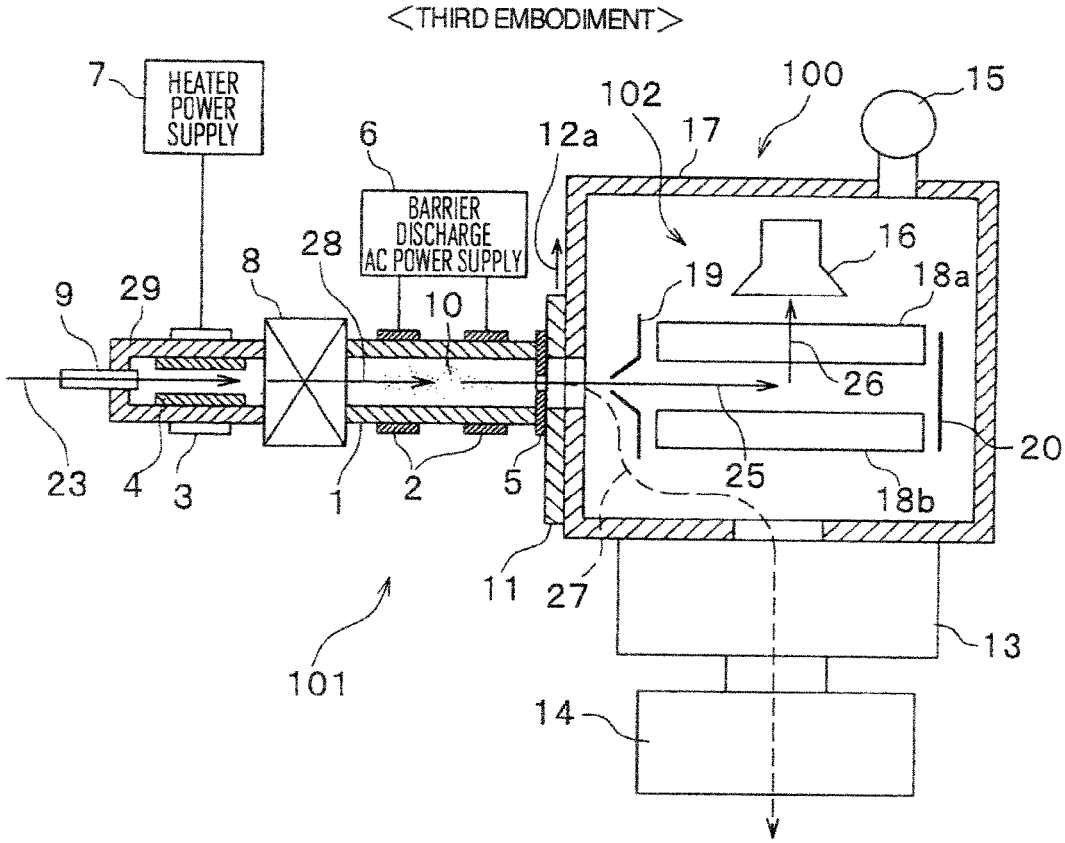
FIG. 7A is a configuration diagram of a mass spectrometer according to a third embodiment of the present invention.

A configuration diagram of a mass spectrometer 100 according to a third embodiment of the present invention is shown in FIG. 7A. The mass spectrometer 100 of the third embodiment differs from the mass spectrometer 100 of the second embodiment in that the pulse valve 8 is arranged between the sample container 29 and the dielectric container 1 and that the capillary 9 is attached to one end of the sample container 29. In other words, the sample container 29 in which a sample 4 is placed is arranged between the pulse valve 8 and the capillary 9 in terms of the flow of atmosphere (air) 23 and/or the flow of sample molecules (gas) 28. Then, the sample container 29 in which the sample 4 is placed is arranged on the downstream side of the flow of atmosphere (air) 23 and/or the flow of sample molecules (gas) 28 with respect to the capillary 9 and on the upstream side of these flows with respect to the pulse valve 8. While the atmosphere is introduced intermittently to the interior of the dielectric container 1 and the interior of the sample container 29 by the opening/closing operation of the pulse valve 8 in the first and second embodiments, the atmosphere and the vaporized sample 4 are introduced intermittently to the dielectric container 1 in the third embodiment. Therefore, only when the pulse valve 8 is opened, the sample 4 is led to the dielectric container 1 and the mass spectroscopy section 102 so that contamination of the dielectric container 1 and the mass spectroscopy section 102 due to the sample 4 can be reduced. Further, since the sample container 29 is mounted on the atmosphere side of the pulse valve 8, replacement of the sample container 29 can easily be conducted.

Variation 1 of Third Embodiment

Figure 7B:
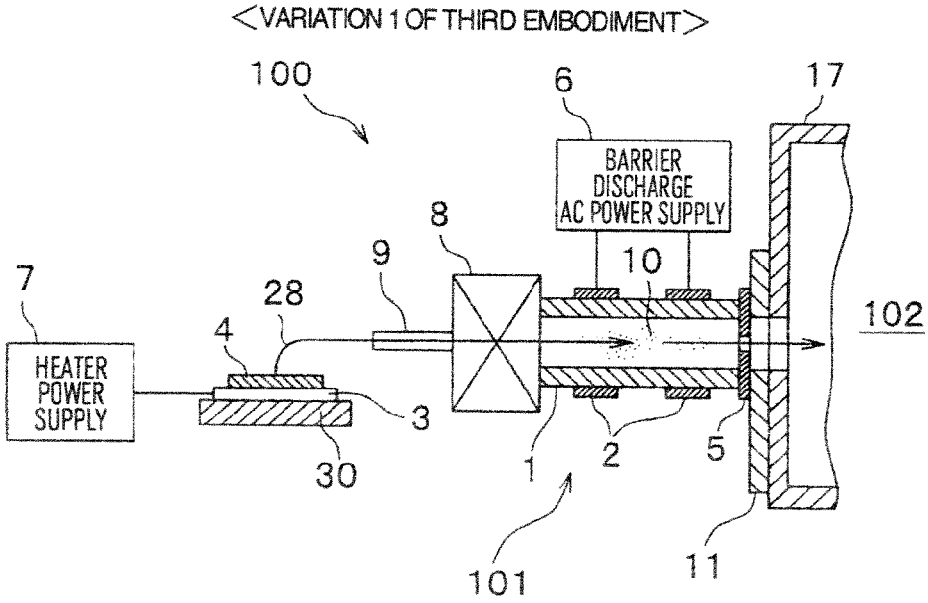
FIG. 7B is part of a configuration diagram showing a mass spectrometer according to Variation 1 of the third embodiment of the present invention.

Illustrated in FIG. 7B is part of a mass spectrometer 100 according to Variation 1 of the third embodiment of the present invention. As compared to the third embodiment, it is different in Variation 1 of the third embodiment that the sample 4 is arranged on the upstream side with respect to the pulse valve 8 and the capillary 9. The sample 4 is arranged on the upstream side with respect to the capillary 9, which in turn is arranged on the upstream side with respect to the pulse valve 8. The sample 4 may be located away independently from the mass spectrometer 100 provided that it is near the tip end of the capillary 9. In Variation 1 of the third embodiment, the sample 4 may simply be placed on a sample stage 30 and this configuration is suitable for the case where the sample 4 is constituted by volatile chemical substances.

Variation 2 of Third Embodiment

Figure 7C:
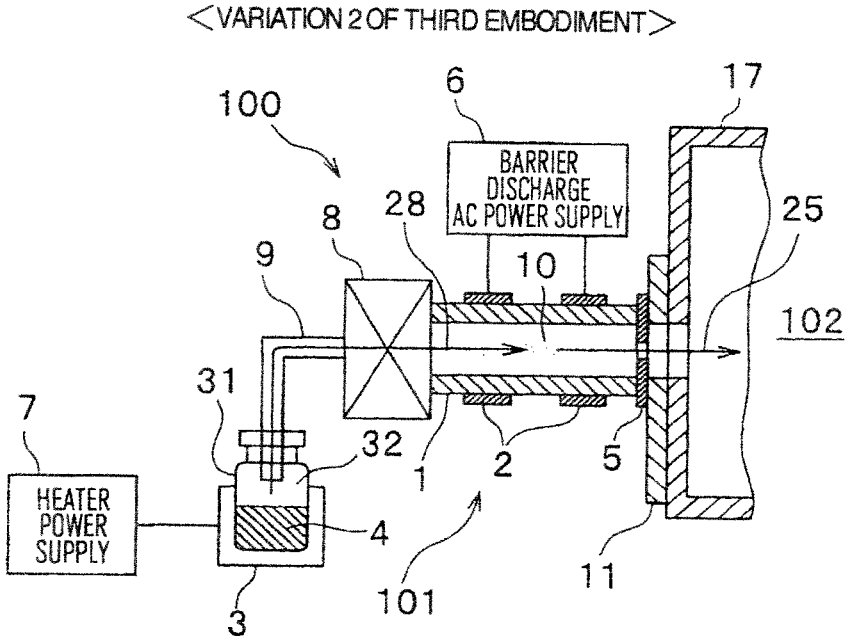
FIG. 7C is part of a configuration diagram showing a mass spectrometer according to Variation 2 of the third embodiment of the present invention.

Illustrated in FIG. 7C is part of a mass spectrometer 100 according to Variation 2 of the third embodiment of the present invention. In Variation 2 of the third embodiment, the sample 4 is arranged on the upstream side of the pulse valve 8 and the capillary 9 similarly to the case of Variation 1. Pursuant to the head space scheme, the sample 4 is put in the vial 31 and gas created by vaporization of the sample 4 in the head space region 32 in the vial 31 is inhaled into the dielectric container 1 from the capillary 9 one end of which is inserted into the head space region 32. When the sample 4 is liquid and contains lots of contaminants, Variation 2 of the third embodiment is suitable since an influence of the contaminants can be reduced.

Variation 3 of Third Embodiment

Figure 7D:
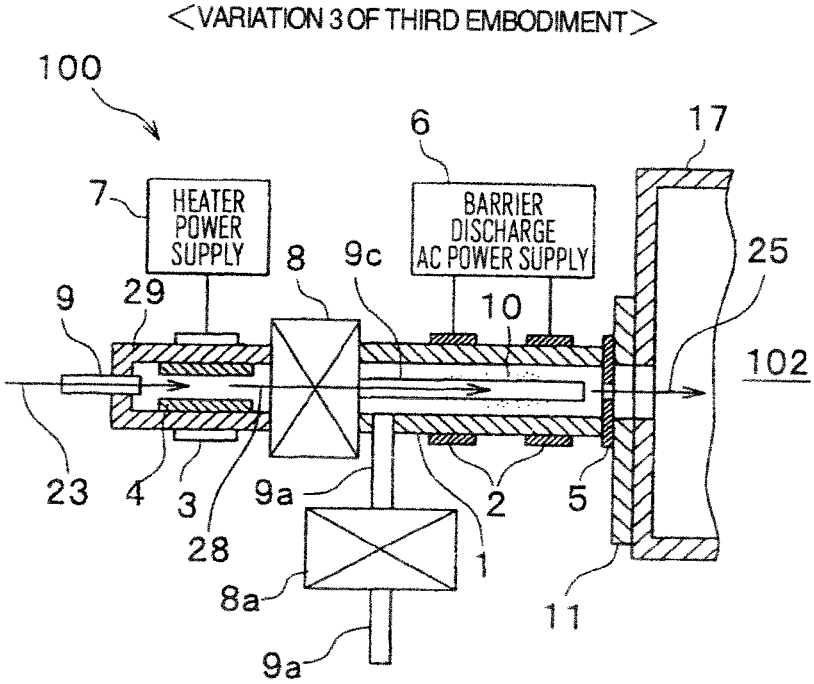
FIG. 7D is part of a configuration diagram showing a mass spectrometer according to Variation 3 of the third embodiment of the present invention.

Illustrated in FIG. 7D is part of a mass spectrometer 100 according to Variation 3 of the third embodiment of the present invention. The mass spectrometer 100 of Variation 3 of the third embodiment differs from the mass spectrometer 100 of the third embodiment in that a capillary 9*c* is provided inside the dielectric container 1. One end of the capillary 9*c* is connected to an outlet of the pulse valve 8. The other end of the capillary 9*c* reaches near the orifice 5 across the barrier discharge region 10 in the dielectric container 1. The capillary 9*c* is cylindrical and its central axis coincides with the central axis of the cylindrical dielectric container 1; the orifice 5 is provided on an extension of the central axis of the capillary 9*c*. Incidentally, the capillary 9*c* is shielded and grounded so that a radio frequency electromagnetic wave radiated from the barrier discharge electrodes 2 will not transmit into its interior.

To the side wall of the dielectric container 1, which is not confronting the barrier discharge region 10 and is on the upstream side, the capillary 9*a* and the pulse valve 8*a* are connected. The pulse valve 8*a* is opened and closed synchronously with the pulse valve 8 so that the atmosphere (water and oxygen molecules) can be introduced to the interior of the dielectric container 1 by way of the capillary 9*a* and the pulse valve 8*a*. Water and oxygen molecules in the introduced atmosphere are ionized into reactant ions in the barrier discharge region 10 inside the dielectric container 1. The reactant ions generated in the barrier discharge region 10 inside the dielectric container 1 move to a neighborhood of one end of the capillary 9*c* due to pressure difference and further to the interior of the dielectric container 1 immediately before the orifice 5. Then, in the interior of the dielectric container 1 immediately before the orifice 5, the gas (sample molecules) flowing in from the capillary 9*c* along with the flow of sample molecules (gas) 28 undergoes ion molecular reactions with the reactant ions, thus generating sample molecule ions. The generated sample molecule ions form a flow of sample molecular ions 25 which in turn flows in from the dielectric container 1 into the vacuum chamber 17 through the orifice 5.

In Variation 3 of the third embodiment, the vaporized sample 4 is led to the downstream side of the barrier discharge region 10 by way of the capillary 9*c* on the downstream of the pulse valve 8. The sample 4 flows inside the capillary 9*c* whereas the atmosphere is ionized outside of the capillary 9*c* to thereby generate reactant ions. On the downstream side of the capillary 9*c*, the sample 4 is ionized by the reactant ions. With this configuration, the barrier discharge region 10 is separated from the flow of sample molecules (gas) 28; therefore, the vaporized sample 4 will not be ionized directly in the barrier discharge region 10 and the sample molecular ions can be generated in ion molecular reactions with the reactant ions of water and oxygen molecules in the atmosphere which are ionized in the barrier discharge region 10 similarly to the case of the first embodiment.

Variation 4 of Third Embodiment

Figure 7E:
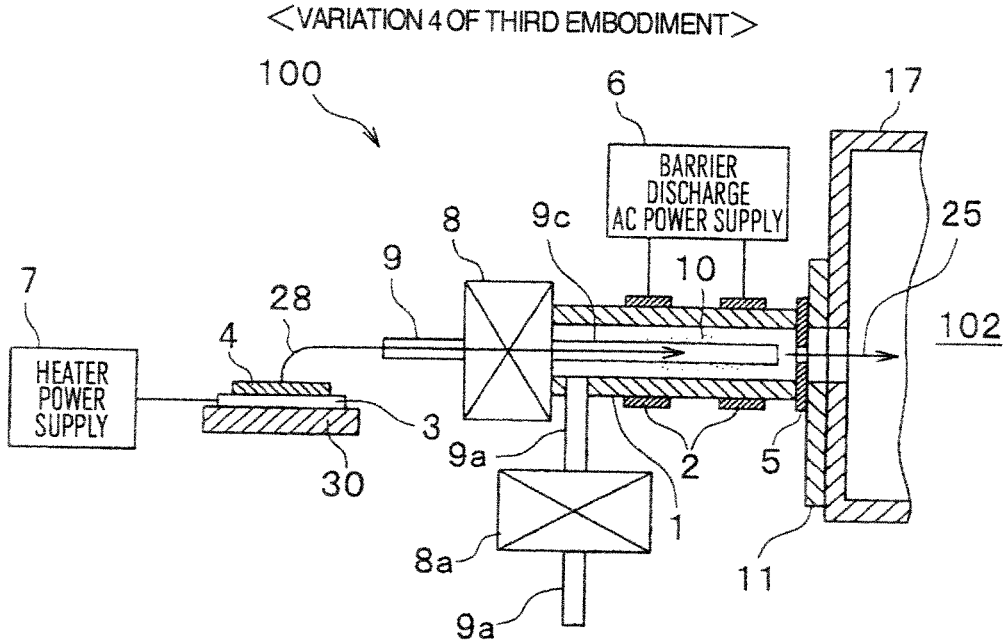
FIG. 7E is part of a configuration diagram showing a mass spectrometer according to Variation 4 of the third embodiment of the present invention.

Illustrated in FIG. 7E is part of a mass spectrometer 100 according to Variation 4 of the third embodiment of the present invention. The mass spectrometer 100 according to Variation 4 of the third embodiment of the present invention has a structure which comprises the upstream side part with respect to the pulse valve 8 of the mass spectrometer 100 of Variation 1 of the third embodiment and the downstream side part with respect to the pulse valve 8 of the mass spectrometer 100 of Variation 3 of the third embodiment combined. Also in Variation 4 of the third embodiment, the vaporized sample 4 passes through the capillary 9*c* on the downstream side of the pulse valve 8 and is led to the downstream side of the barrier discharge region 10. With this configuration, the barrier discharge region 10 is separated from the flow of sample molecules (gas) 28 and, therefore, the vaporized sample 4 will not be ionized directly in the barrier discharge region 10 so that the sample molecular ions can be generated in ion molecular reactions with the reactant ions of water and oxygen molecules in the atmosphere which are ionized in the barrier discharge region 10 like the first embodiment.

Variation 5 of Third Embodiment

Figure 7F:
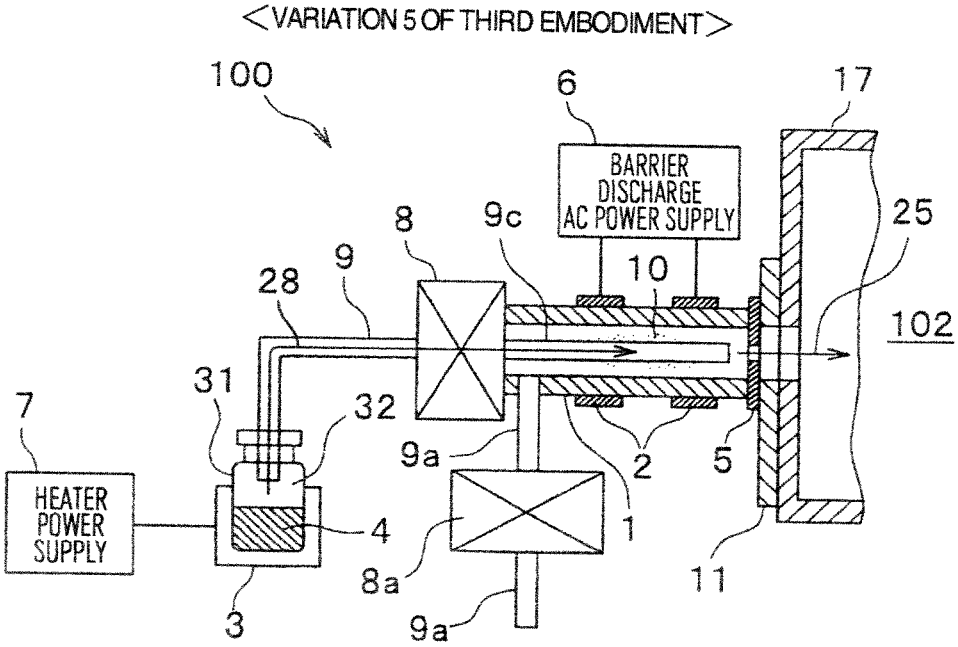
FIG. 7F is part of a configuration diagram showing a mass spectrometer according to Variation 5 of the third embodiment of the present invention.

Illustrated in FIG. 7F is part of a mass spectrometer 100 according to Variation 5 of the third embodiment of the present invention. The mass spectrometer 100 according to Variation 5 of the third embodiment of the present invention has a structure which comprises the upstream side part with respect to the pulse valve 8 of the mass spectrometer 100 of Variation 2 of the third embodiment and the downstream side part with respect to the pulse valve 8 of the mass spectrometer 100 of Variation 3 of the third embodiment combined. Also in Variation 5 of the third embodiment, the vaporized sample 4 passes through the capillary 9*c* on the downstream side of the pulse valve 8 and is led to the downstream side of the barrier discharge region 10. With this configuration, the barrier discharge region 10 is separated from the flow of sample molecules (gas) 28 and, therefore, the vaporized sample 4 will not be ionized directly in the barrier discharge region 10 so that the sample molecular ions can be generated in ion molecular reactions with the reactant ions of water and oxygen molecules in the atmosphere which are ionized in the barrier discharge region 10 like the first embodiment.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A mass spectrometer comprising:

an ion source adapted to ionize gas flowing in from outside in order to ionize a measurement sample, the ion source comprising:

a dielectric bulkhead configured to reduce pressure of an interior of the ion source, and first and second electrodes across which alternating-current voltage is applicable through the dielectric bulkhead, and whereby the gas is ionized by discharge generated inside of the ion source with application of the alternating-current voltage;

a mass spectroscopy section for separating the ionized measurement sample;

a restriction device for suppressing a flow rate of the gas that the ion source inhales; and an open/close device for opening and closing a flow of the gas that the ion source inhales, wherein:

the ion source has its interior reduced in pressure by differential pumping from the mass spectroscopy section and ionizes the gas when its interior pressure rises up to about 100 Pa to about 10,000 Pa as it inhales the gas, and the mass spectroscopy section separates the ionized measurement sample when its interior pressure raised concomitantly with inhale of the gas falls to about 0.1 Pa or lower after inhale of said gas.

2. The mass spectrometer according to claim 1, wherein the restriction device and the open/close device are arranged on an upstream side of flow of the gas with respect to the ion source.

3. The mass spectrometer according to claim 1, wherein the first and second electrodes are arranged outside of the dielectric bulkhead of the ion source.

4. The mass spectrometer according to claim 1, wherein:

after the mass spectroscopy section separates the ionized measurement sample while an interior pressure of the mass spectroscopy section has fallen to about 0.1 Pa or lower, the ion source ionizes the gas when the interior pressure of the ion source again rises up to about 100 Pa to about 10,000 Pa by inhaling the gas, whereby mass spectroscopy of the measurement sample is conducted repeatedly.

5. The mass spectrometer according to claim 1, wherein the gas flowing in the ion source is air or a gas containing air.

6. The mass spectrometer according to claim 1, further comprising:

a first orifice or a first capillary disposed at an inlet of a vacuum chamber containing the mass spectroscopy section, the inlet being on upstream side of flow of the gas with respect to said vacuum chamber, and adapted for reducing the interior pressure of the ion source by differential pumping from the mass spectroscopy section.

7. The mass spectrometer according to claim 1, wherein the restriction device is a second orifice or a second capillary.

8. The mass spectrometer according to claim 1, wherein the open/close device is a pulse valve configured to permit time duration for opening about 200 m seconds or less.

* * * * *